US005926680A

United States Patent [19]

Yamamoto et al.

[11] Patent Number: 5,926,680

[45] Date of Patent: Jul. 20, 1999

[54] FIXING UNIT

[75] Inventors: Kasumi Yamamoto; Masatoshi Takano; Tomoyuki Nishikawa; Tsutomu Sato; Tsukasa Yanashima; Yutaka Ishikawa; Hiroyuki Saito, all of Tokyo, Japan

[73] Assignee: Asahi Kogaku Kogyo Kabushiki Kaisha, Tokyo, Japan

[21] Appl. No.: 08/892,663

[22] Filed: Jul. 14, 1997

[30] Foreign Application Priority Data

Jul. 16, 1996 [JP] Japan ..... 8-205239
Jul. 30, 1996 [JP] Japan ..... 8-216801

[51] Int. Cl.[6] ..... G03G 15/20

[52] U.S. Cl. ..... 399/328; 399/67

[58] Field of Search ..... 399/67, 320, 328, 399/330, 331, 332, 122

[56] References Cited

U.S. PATENT DOCUMENTS 5,087,947 2/1992 Torino ..... 399/328 X
5,187,528 2/1993 Nishikawa et al. .
5,422,710 6/1995 Shirasaka et al. ..... 399/328 X
5,432,593 7/1995 Nishikawa et al. ..... 399/328
5,450,181 9/1995 Tsukida et al. ..... 399/328 X
5,467,178 11/1995 Mui et al. ..... 399/328
5,689,788 11/1997 Moser ..... 399/328

*Primary Examiner*—Sandra Brase
*Attorney, Agent, or Firm*—Greenblum & Bernstein, P.L.C.

[57] ABSTRACT

A fixing unit, used for fixing images on a recording sheet, includes a heat roller accommodating a heater, and a press roller movable between a retracted position and an operating position. The heat roller is rotated by a driving mechanism. A moving mechanism opens and closes a gap between the press roller and the heat roller by moving the press roller between the retracted position and the operating position. An assist gear rotates the press roller in a predetermined direction when the opening/closing mechanism moves the press roller toward the operating position.

19 Claims, 23 Drawing Sheets

FIXING UNIT

BACKGROUND OF THE INVENTION

The invention relates to a fixing unit used in a printer such as an electrophotographic printer, for fixing images on a recording sheet.

In a printer such as an electrophotographic printer, a fixing unit is provided for fixing the toner image on the recording sheet. The fixing unit includes a heat roller accommodating a heater therein and a press roller having a surface made of an elastic member. A recording sheet is pressed and heated between the heat roller and the press roller, so that the toner image is fixed on the recording sheet.

Generally, the heat roller is rotated by a driving mechanism, while the press roller is supported freely. Further, the press roller is moved toward and away from the heat roller. That is, the press roller is moved between (1) an operating position where the press roller presses the recording sheet to the heat roller and (2) a retracted position where the press roller is separated from the heat roller.

The heat roller is rotated in synchronization with the feeding of the recording sheet (generally performed by a tractor unit). If the feeding of the recording sheet is stopped while the recording sheet is in contact with the heat roller for a long time, the recording sheet may dry out. In order to avoid this problem, the printer is so arranged that the recording sheet is held (pressed) by the heat roller and the press roller only when the recording sheet is being fed. That is, the press roller is moved to the operating position after a feeding of the recording sheet is started.

However, the press roller is not rotated when located at the retracted position, while the recording sheet is fed with a certain speed. Thus, there is a significant speed difference between the recording sheet and the press roller at a moment when the press roller contacts the recording sheet. If one lateral end of the recording sheet is brought into contact with the press roller earlier than the other lateral end of the press roller, the end which initially contacts the recording sheet may decelerate for a moment, while the other lateral end may decelerate. This causes a so-called skew wherein the recording sheet is inclined with respect to the feeding direction of the recording sheet.

Further, if the above-described deceleration of the recording sheet occurs at the fixing unit, it may decelerate the recording sheet passing through a transfer unit (located at an upstream of the fixing unit) where the toner image is transferred on the recording sheet. Thus, it may cause a so-called jitter wherein the transfer position of the toner image on the recording sheet is fluctuated.

SUMMARY OF THE INVENTION

It is therefore an object of the present invention to provide a fixing unit wherein a skew and jitter of the recording sheet is prevented.

According to an aspect of the invention, there is provided a fixing unit including a heat roller accommodating a heater, a press roller for pressing a recording sheet to the heat roller, an opening/closing mechanism which opens and closes a gap between the press roller and the heat roller, and a rotating mechanism which rotates one of the heat roller and the press roller. The fixing unit further includes a rotation-providing mechanism which rotates the other roller of the press roller and the heat roller so that the other roller is rotating when the opening/closing mechanism is closing the gap.

As constructed above, since the remaining roller is rotating when the opening/closing mechanism is closing the gap, the recording sheet does not decelerate when the opening/closing mechanism is closing the gap. Thus, skew (which may occur if there is a significant speed difference between the recording sheet and the roller) or jitter (which may occur if the recording sheet decelerates significantly can be prevented.

In a particular arrangement, the press roller is movable between an operating position where the press roller and the heat roller sandwich the recording sheet and a retracted position where the press roller is retracted from the operating position. In this case, the opening/closing mechanism moves the press roller between the retracted position and the operating position. Further, the rotating mechanism rotates the heat roller, and the rotation-providing mechanism rotates to the press roller when the opening/closing mechanism is closing the gap.

In one case, the rotation-providing mechanism includes a driven gear provided to the press roller and a driving gear that engages the driven gear when the press roller is positioned at the retracted position. With this, it becomes possible to provide initial rotation to the press roller in a simple manner. In this case, it is preferable to provide a transmission mechanism which transmits rotation of the rotation mechanism to the driving gear. Alternatively, it is possible that the driven gear is rotated by the movement of the driven gear with respect to the driving gear, caused by the movement of the press roller from the retracted position to the operating position.

In another case, the rotation-providing mechanism includes a contact roller that is in contact with a surface of the press roller when the press roller is positioned at the retracted position. In this case, it is preferable that the contact roller is rotated by the rotating mechanism. Alternatively, it is possible that the press roller is rotated by the movement of the press roller with respect to the contact roller, caused by the movement of the press roller from the retracted position to the operating position.

Optionally, the rotation-providing mechanism may be a slide arm movable in a tangential direction of the press roller. The slide arm has a contact member which is in contact with a surface of the press roller when the press roller is positioned at the retracted position. The rotation-providing mechanism may include a fan for supplying air to the press roller and an impeller provided on the press roller to receive the air supplied from the fan, thereby rotating the press roller. In this case, the impeller is provided at least one axial end of the press roller.

According to another aspect of the invention, there is provided a fixing unit including a heat roller accommodating a heater, a press roller for pressing a recording sheet to the heat roller, and an opening/closing mechanism which opens and closes a gap between the press roller and the heat roller. Axial end portions of at least one of the press roller and the heat have an outer diameter larger than an outer diameter of a portion interposed between the axial end portions.

With such an arrangement, both rollers contact with each other via axial end diameter portions, so that the rotation of one roller is transmitted to the other roller. Thus, both rollers are rotating when the recording sheet is held between the heat roller and the press roller, which prevents the occurrence of skew and jitter. Further, the heat roller and the press roller are parallel since one roller biases the other roller via the axial portions, so that the recording sheet is uniformly pressed. Thus, skew of the recording sheet can be further prevented.

In a particular arrangement, a distance between the axial end portions is larger than a width of the recording sheet. Further, a difference in radius between the axial end portions and the interposed portion is larger than the thickness of the recording sheet.

Preferably, a hollow space may be formed in each axial end portion so that the large diameter portion is easily deformed. Further, it is possible that each axial end portion is tapered to have a diameter increasing linearly toward the outermost end thereof.

DESCRIPTION OF THE PREFERRED EMBODIMENTS

A first embodiment of the present invention is described with reference to accompanied drawings.

Figure 1:
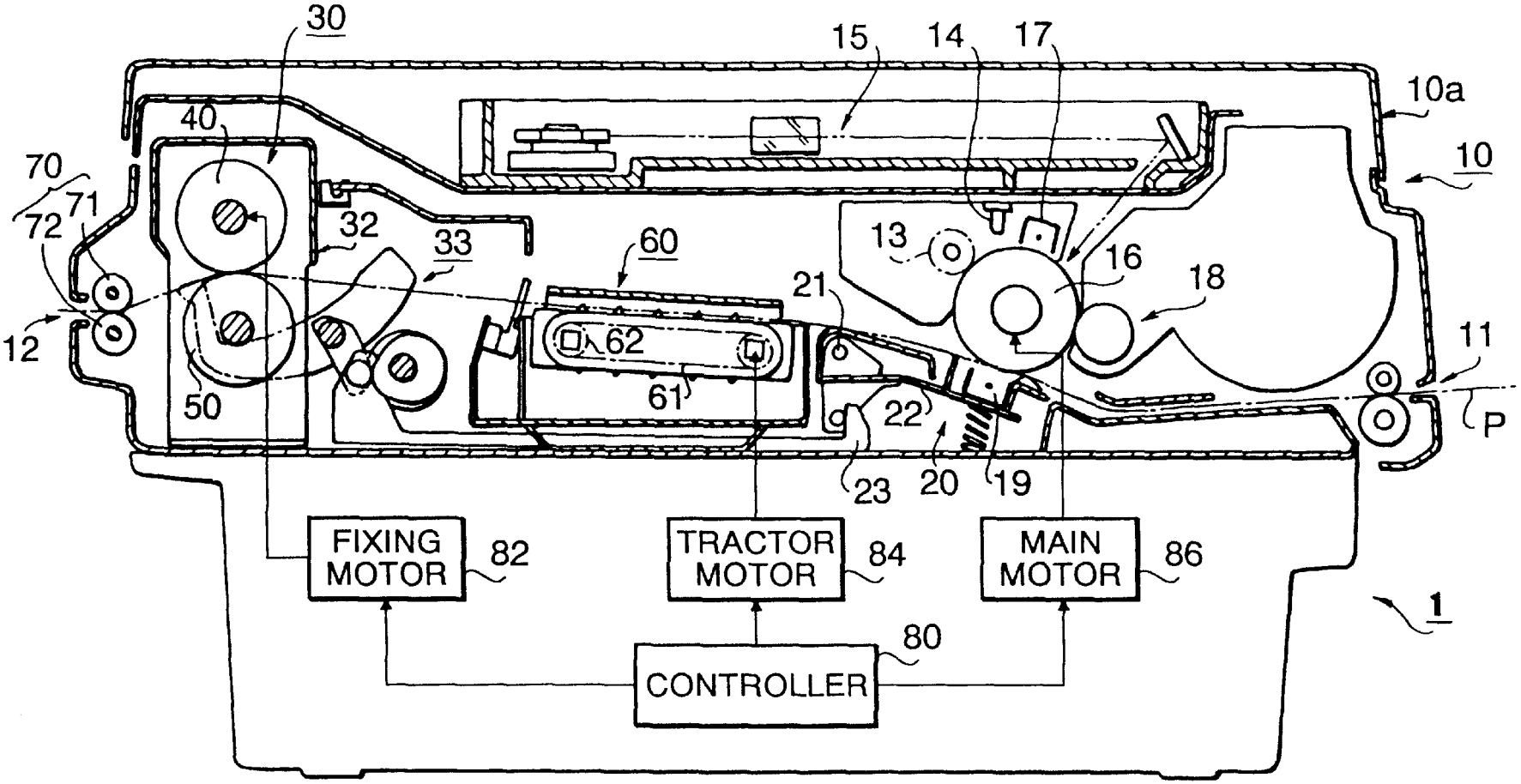
FIG. 1 is a sectional side view showing a arrangement of a printer.

FIG. 1 shows a continuous form printer 1 arranged to print images on a continuous recording sheet P using a so-called electrophotographic technology. The printer 1 includes a laser scanning unit 15 for emitting a laser beam, a photoconductive drum 16 on which a latent image is formed by the laser beam emitted from the laser scanning unit 15, a developing unit 18 for applying toner to the latent image formed on the drum 16, a transfer unit 20 for transferring a toner image from the drum 16 onto recording sheet P, and a fixing unit 30 for fixing the toner image on the recording sheet P, all of which are accommodated in a housing 10.

The printer 1 further includes a cleaning unit 13 for removing residual toner on the drum 16, a discharge unit 14 for discharging the photoconductive surface of drum 16, and a charging unit 17 for uniformly charging the photoconductive surface of drum 16.

The recording sheet P enters into the housing 10 from a sheet inlet 11 provided at one side thereof. In the housing 10, the recording sheet P passes through the above-described transfer unit 20 and fixing unit 30 along a predetermined feeding path. Then, the recording sheet P is discharged from the housing 10 from a sheet outlet 12 provided at the other side thereof. Feeding of the recording sheet P in the housing 10 is performed by a tractor unit 60 provided between the transfer unit 20 and the fixing unit 30.

The tractor unit 60 comprises a tractor belt 61 entrained by a pair of pulleys 62. The tractor belt 61 has projections aligned in a row with predetermined pitches. These projections are engageable with feeding holes opened at lateral ends of the recording sheet P with predetermined intervals equivalent to the pitches of the projections. Pulleys 62 are driven by a tractor motor 84. A discharge roller unit 70, for discharging the recording sheet P, is provided between the fixing unit 30 and the sheet outlet 12.

A printing process is performed as follows: A laser beam is emitted from the laser scanning unit 15. The photoconductive surface of drum 16 is exposed by this laser beam. The photoconductive surface of drum 16 is uniformly charged by a charging unit 17 and is exposed by the above-described laser beam so as to form a latent image. The developing unit 18 applies toner to the latent image formed on the drum 16. Toner image is thus formed on the photosensitive surface of the drum 16 and is transferred onto the recording sheet P at a corona charger 19 provided in the transfer unit 20. The toner image transferred onto the recording sheet P is fixed on the recording sheet P by the fixing unit 30 under a given pressure and heat. Residual toner remaining on the photoconductive surface of the drum 16 is removed by the cleaning unit 13. Further, the photoconductive surface of drum 16 is discharged by the discharge unit 14 for the next printing process. A controller 80 controls the tractor motor 84 actuating the tractor unit 60, a later-described fixing motor 82 actuating the fixing unit 30 and a main motor 86 rotating the drum 16. The housing 10 has an upper housing 10*a* swingably supported by a support shaft (not shown). The laser scanning unit 15 is accommodated in this upper housing 10*a*. By opening the upper housing 10*a*, a user can access the fixing unit 30 or the tractor unit 60 from the top of the printer 1.

The fixing unit 30 includes a heat roller 40 accommodating a heat source therein and a press roller 50 having a surface made of an elastic member. The heat roller 40 and the press roller 50 are accommodated in a detachable unit 32 which can be removed from the printer 1 by opening the upper housing 10*a*.

Furthermore, the fixing unit 30 includes an opening/closing mechanism 33 which opens and closes the gap between the heat roller 40 and the press roller 50. Specifically, the opening/closing mechanism 33 moves the press roller 50 between (1) an operating position where the press roller 50 presses the recording sheet P against the heat roller 40 and (2) a retracted position where the press roller 50 is separated from the heat roller 40. The opening/closing mechanism 33 closes the gap between the rollers when the recording sheet is fed and opens the gap when the recording sheet is stopped.

The transfer unit 20 and the discharge rollers 70 are also controlled in synchronization with the opening/closing mechanism 33 of the fixing unit 30. In the transfer unit 20, the corona charger 19 is provided on a swingable holder 22 swingably supported about a swing shaft 21. The swingable holder 22 swingable between an operating position where the corona charger 19 faces the drum 16 and a retracted position where the corona charger 19 is separated from the drum 16. The swingable holder 22 is swung by a slide arm 23 that is slidable in a right-and-left direction in FIG. 1 synchronous with the opening/closing mechanism 33.

The discharge roller unit 70 includes upper and lower rollers 71 and 72 arranged at both upper and lower sides of the feeding path of the recording sheet P. The upper roller 71 is linked with the opening/closing mechanism 33 by a linking mechanism (not shown) and movable between an operating position where the upper roller 71 presses the recording sheet P to the lower roller 72 and a retracted position where the upper roller 71 is separated from the lower roller 72.

After the printing process is terminated, the printer 1 discharges the leading side of the recording sheet P out of the housing 10 by a length corresponding to an printed page, to enable users to cut the printed page off the printer 1 or to check the printed image. When the next printing process is started, the recording sheet P is retracted back into the housing 10. Then, the opening/closing mechanism 33 moves the press roller 50, corona charger 19 and the upper roller 71 to their retracted positions respectively to open the gap therebetween.

Figure 2:
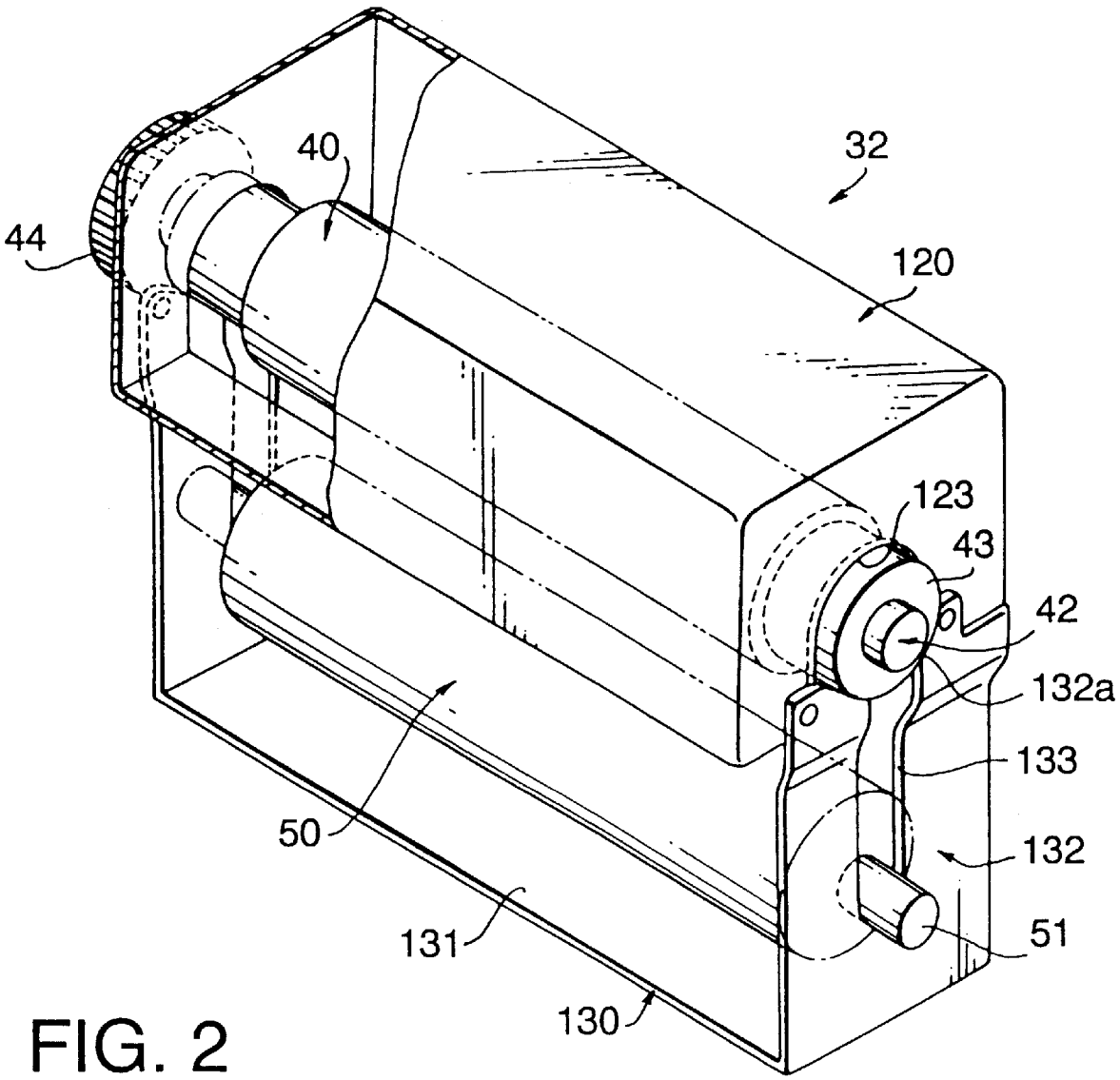
FIG. 2 is a perspective view showing a heat roller, a press roller and a frame arrangement of a fixing unit.

FIG. 2 is a perspective view of the detachable unit 32 including the heat roller 40 and the press roller 50. As shown in FIG. 2, the heat roller 40 and the press roller 50 are supported in parallel with each other in a upper and lower frames 120 and 130. The upper frame 120 is a rectangular box with an open bottom. The lower frame 130 is an angled plate member, which has bottom plate 131 having substantially the same longitudinal length as the upper frame 120, and opposed side plates 132 vertically extending from the longitudinal ends of the bottom plate 130 toward the upper frame 120.

The lower frame 130 is provided with U-shaped grooves 133 extending downward from an upper end 132*a* of each side plate 132. Each groove 133 has a width slightly wider than a support shaft 51 (described below) of the press roller 50 so that the support shaft 51 can be inserted from the upper end 132*a* of the side plate 132 and guided downward along the groove 133 to the lowermost end of the groove 133. The upper frame 120 is provided with U-shaped grooves 123 extending upward from a lower end of each longitudinal side wall. Each groove 123 has a width slightly larger than an outer diameter of a bearing 43 (described below) of the heat roller 40. Each upper end 132a of the side plate 132 has a curved portion at a region corresponding to the lower end of the bearing 43. The curved portion of the upper end 132*a* fits to the peripheral surface of the bearing 43. Accordingly, the bearing 43 is supported by the groove 123 of the upper frame 120 and the curved portion of the upper end 132*a* of the side plate 132.

Figure 3:
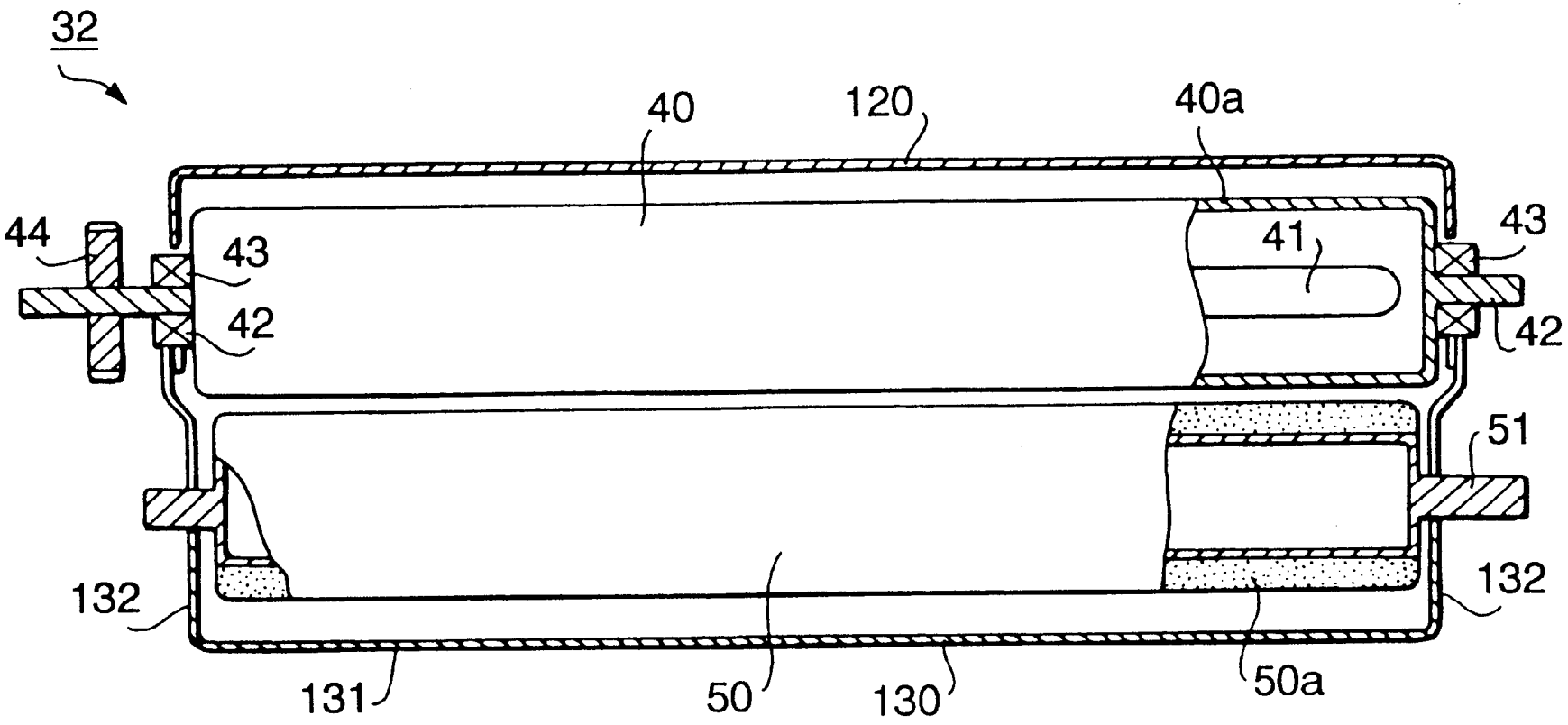
FIG. 3 is a sectional front view showing the heat roller, press roller and the frame arrangement shown in FIG. 2.

FIG. 3 is a partial cutaway view of the detachable unit 32. The heat roller 40 has a hollow roller body 40*a* accommodating a heater 41 therein. Support shafts 42 are integrally formed at respective longitudinal ends of the roller body 40*a*. These shafts 42 are supported by the radial bearings 43. A roller gear 44 is fixed to one of support shafts 42. A driving force for rotating the heat roller 40 is transmitted through the roller gear 44 to the roller body 40*a*.

The press roller 50 includes a roller body 50*a* having a cylindrical surface covered by an elastic member, such as rubber. Support shafts 51 are integrally formed with the roller body 50*a* so as to protrude from the longitudinal ends thereof. The press roller 50 is not directly linked to a driving source but is rotatable in accordance with a rotation of the heat roller 40 when the press roller 50 is pressed against the heat roller 40 with a recording sheet P interposed therebetween.

When the heater 41 of the heat roller 40 is activated, heat from heater 41 is transmitted to the upper and lower frames 120 and 130 (through the roller body 40*a*, the support shaft 42 and the bearing 43). A predetermined amount of clearances is provided between the support shaft 42 and the bearing 43 and between the bearing 43 and the upper frame 120 to allow for thermal expansion due to the gradual temperature rise.

Figure 4:
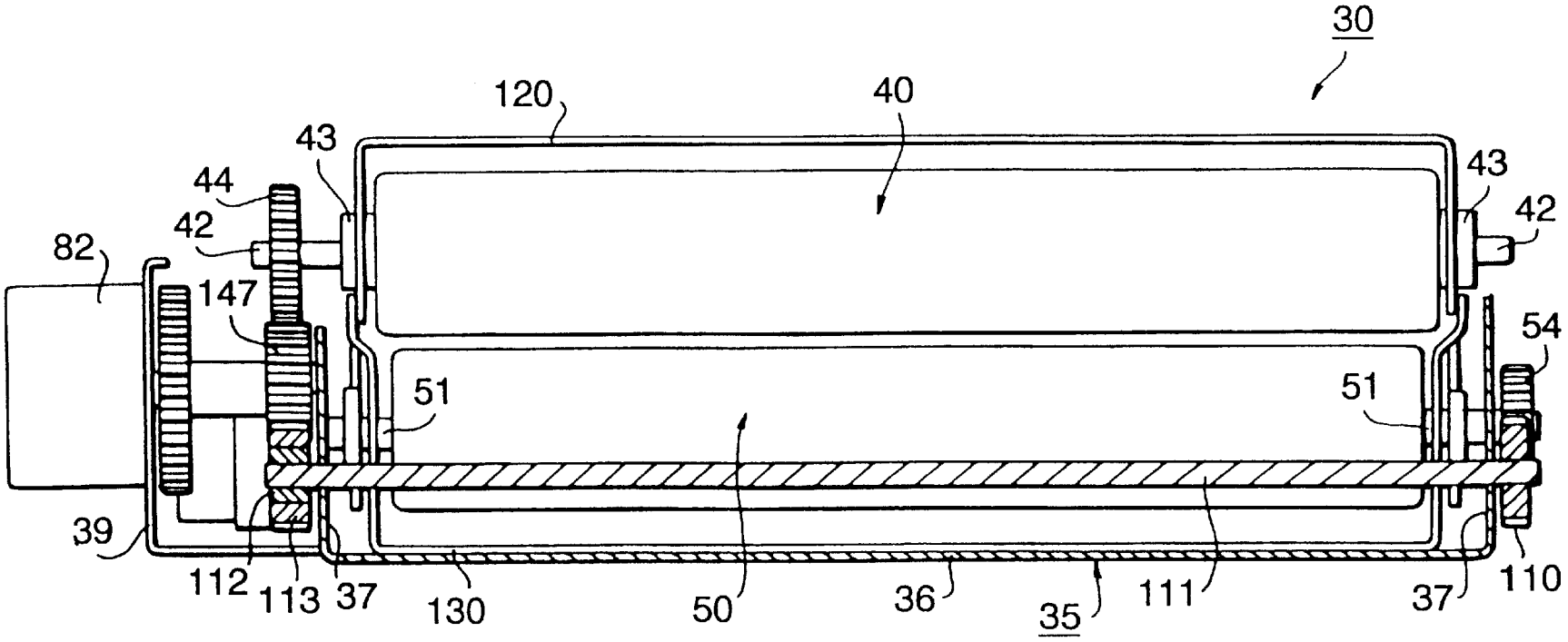
FIG. 4 is a sectional front view showing a fixing unit according to a first embodiment.

FIG. 4 is a sectional view showing the fixing unit 30 seen from the downstream side (left in FIG. 1). The fixing unit 30 is mounted on a rectangular base frame 35 having opposed side plates 37 vertically extending from longitudinal ends of a rectangular base plate 36. A motor mounting plate 39 for mounting fixing motor 82 is attached to one of side plates 37. One of support shafts 51 of press roller 50 is positioned at a far side with respect to the motor mounting plate 39, penetrating the side plate 37. At a distal end of the protruded support shafts 51, a press roller gear 54 is securely fixed.

A support shaft 111 is provided at the downstream side (left in FIG. 1) of the press roller 50, which extends in parallel with the press roller 50. Both axial ends of support shaft 111 penetrate the side plates 37, respectively. One end of this support shaft 111 adjacent to the motor mounting plate 39 is provided with a transmission gear 113 with a one-way clutch 112 provided between the transmission gear 113 and the support shaft 111. The other end of support shaft 111 is provided with a assist gear 110, which is engageable with the press roller gear 54 when the press roller 50 is positioned at the retracted position.

Figure 5:
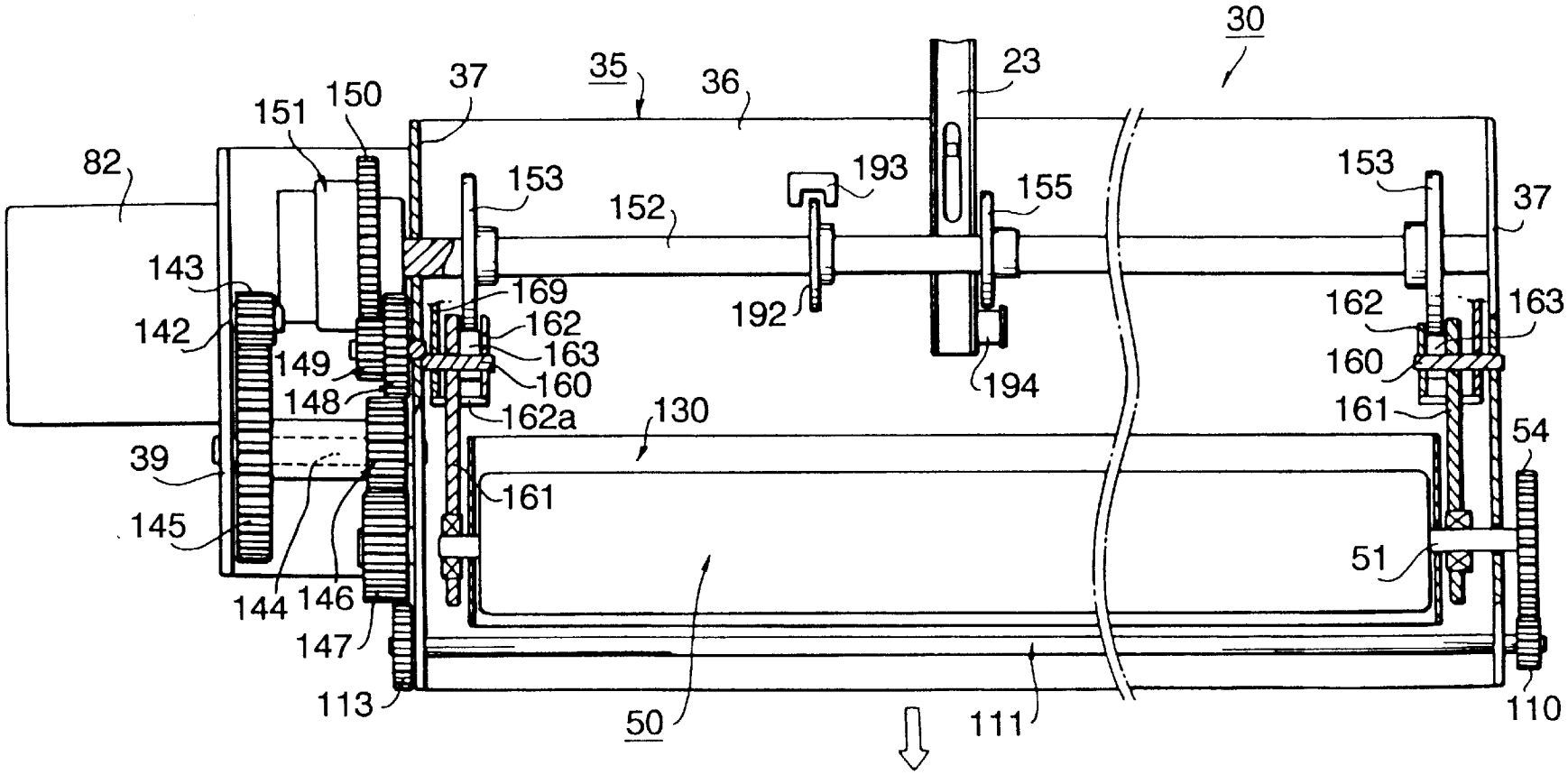
FIG. 5 is a sectional plan view showing the fixing unit of FIG. 4.

FIG. 5 is a plan view of the fixing unit 30 with the heat roller 40 and the upper frame 120 omitted. In FIG. 5, an arrow denotes a recording sheet feeding direction. The motor mounting plate 39 is positioned in parallel with the associated side plate 37. The fixing motor 82 is placed on the mounting plate 39, so that an output shaft 142 of the fixing motor 82 protrudes toward this side plate 37. A motor gear 143 is fixed to the output shaft 142 of the fixing motor 82. The motor gear 143 meshes with a first gear 145 rotatably provided to a support shaft 144 bridging the side plate 37 and the motor mounting plate 39. A second gear 146 is provided to the support shaft 144 so that the second gear 146 is integrally rotatable with the first gear 145. The second gear 146 meshes with a third gear 147 rotatably supported on the side plate 37. The third gear 147 meshes with the roller gear 44 (FIG. 3) of the heat roller 40. The third gear 147 further meshes with the transmission gear 113 fixed to the support shaft 111. A rotation of heat roller 40 is thus transmitted to the assist gear 110 via the transmission gear 113 and the support shaft 111.

As shown in FIG. 5, the second gear 146 meshes with a fourth gear 148 rotatably supported on the side plate 37. A fifth gear 149 is fixed coaxially with the fourth gear 148. A sixth gear 150 meshes with the fifth gear 149, which is connected via a electromagnetic clutch 151 to a cam shaft 152. Thus, a driving force of fixing motor 82 is transmitted to the cam shaft 152 according to an on-off condition of the electromagnetic clutch 151.

The cam shaft 152 extends in the longitudinal direction of the base frame 35 (i.e., in parallel with the press roller 50). Both axial ends of this cam shaft 152 are supported by the opposed side plates 37 and 37 of the base frame 35. First disk cams 153 and 153 are fixed on the cam shaft 152 at predetermined inward portions adjacent to the side plates 37 and 37, respectively. The first disk cams 153 and 153 are used for moving the press roller 50 thereby to open and close the gap between the heat roller 40 and the press roller 50. An encoder wheel 192 is fixed at a longitudinal central portion of the cam shaft 152. A photo-interrupter 193 is provided on the bottom plate 36 of the base frame 35 at a position adjacent to the encoder wheel 192. The encoder wheel 192 and the photo-interrupter 193 cooperatively detect a rotational angle of cam shaft 152. A second disk cam 155 is fixed on the cam shaft 152 at the longitudinal central portion. The second disk cam 155 is used for swinging the swing holder 22 holding the corona charger 19 of the transfer unit 20 (FIG. 1). Specifically, the second disk cam 155 contacts a cam follower 194 fixed on the end of slide arm 23 (FIG. 1). The rotation of the cam shaft 152 is converted into a reciprocal motion of the slide arm 23 swinging the swingable holder 22.

Figure 6A:
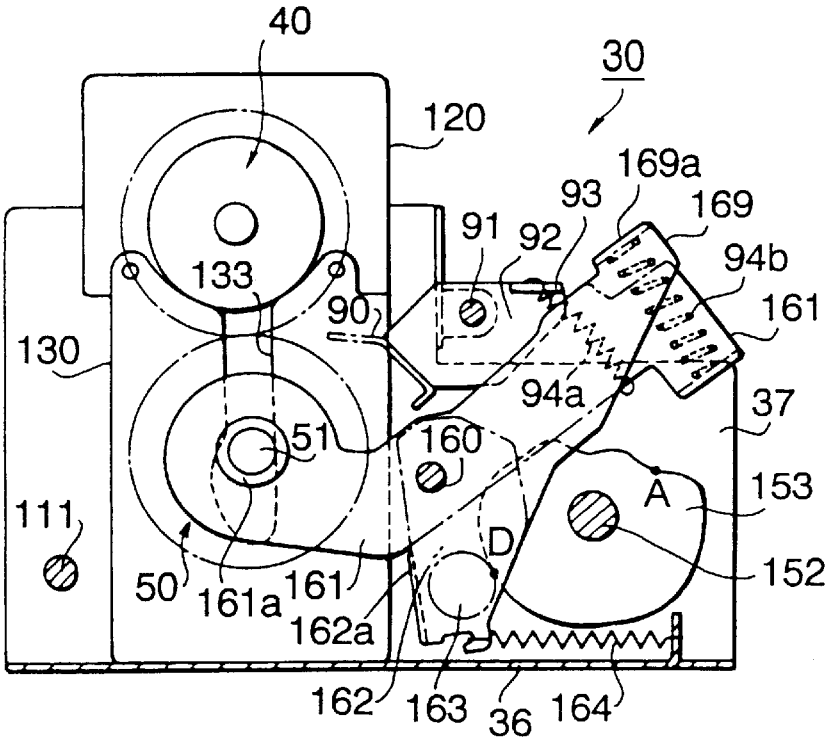
FIGS. 6A and 6B are sectional side views showing the fixing unit of FIG. 4.
Figure 6B:
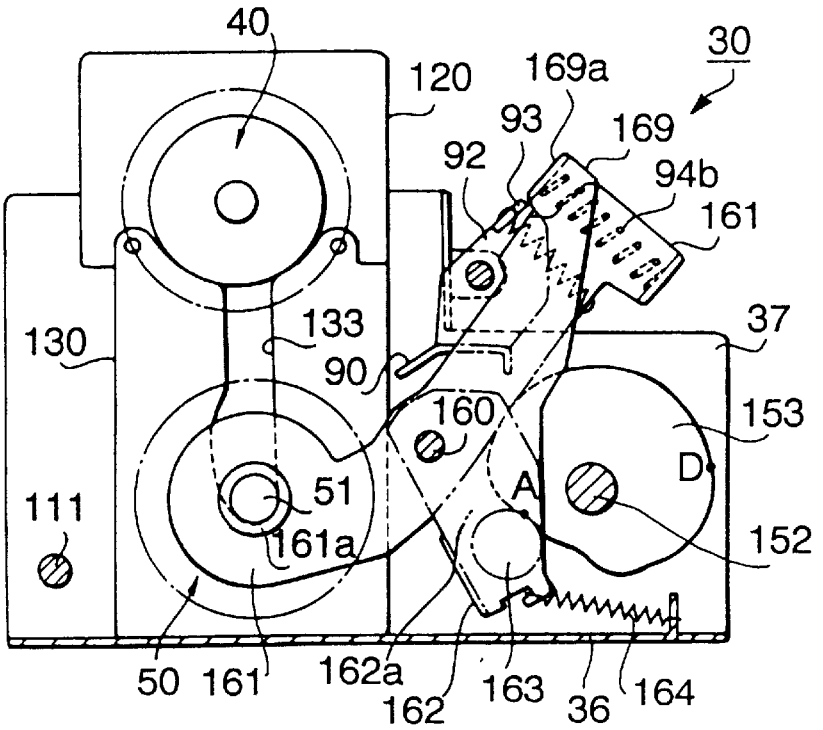

FIGS. 6A and 6*b* are sectional side views showing the fixing unit 30. The support shafts 51 of the press roller 50 are rotatably held by a pair of swing arms 161 (one of which is not shown in FIGS. 6A and 6*b*) via radial bearings 161*a*. Each swing arm 161 is swingable about a swinging shaft 160 provided on each side plate 37, so that the press roller 50 is moved in the substantially vertical direction along the grooves 133.

A cam follower 163 (engaging the disk cam 153) is provided to a first plate 162 rotatably provided around the shaft 160. The first plate 162 is integrally formed with a second plate 169 in parallel with each other, with a bridge plate 162*a* bridging both plates 162 and 169. The second plate 169 (and the first plate 162) is integrally swingable with the swing arm 161 via a compression spring 94*b* provided between the second plate 169 and the swing arm 161. The first plate 162 is biased by a tension spring 164 having one end fixed to the bottom plate 36, so that the cam follower 163 always engages with the disk cam 153. Thus, rotation of the disk cam 153 is transmitted to the cam follower 163 and converted into a swing motion of the plates 169 and 162, which is further transmitted to the swing arm 161. The fixing unit 30 is provided with two sets of the disk cam 153, the cam follower 163, the first plate 162 and the second plate 169 (as shown in FIG. 5), for swinging the two swinging arms 161 supporting both ends of the press roller 50.

With such an arrangement, the press roller 50 is vertically moved by the swinging of the swing arm 161. The disk cam 153 has a maximum radius at a point "D" and a minimum radius at a point "A". When the maximum radius point "D" of disk cam 153 contacts with the cam follower 163, the press roller 50 is pressed against the heat roller 40 as shown in FIG. 6A. When the minimum radius point "A" of disk cam 153 contacts with the cam follower 163, the press roller 50 is separated from the heat roller 40 as shown in FIG. 6B. In this manner, the press roller 50 is moved between the operating position and the retracted position.

In order to guide the recording sheet P through the gap between the heat roller 40 and the press roller 50, a swingable guide plate 90 is provided. The guide plate 90 is fixed to two side plates 92 and 92 (one of which is not shown in FIGS. 6A and 6B). Each side plate 92 is supported around a shaft 91 provided on respective side plate 37. The guide plate 90 is provided with a flange 93 abutting the upper end of the swing arm 161. A tension spring 94*a* is provided between the flange 93 and the swing arm 161. When the swing arm 161 is positioned at the retracted position (FIG. 6B), recording sheet P is separated from both of the heat roller 40 and the press roller 50 by the guide plate 90.

The arrangement for providing rotation to the press roller is described.

As shown in FIG. 5, the third gear 147 meshes with the transmission gear 113. The fixing motor 82 rotates the heat roller 40 via first, second and third gears 145, 146 and 147. The rotation of the fixing motor 82 is also transmitted to the support shaft 111 and the assist gear 110 via the transmission gear 113.

Figure 7:
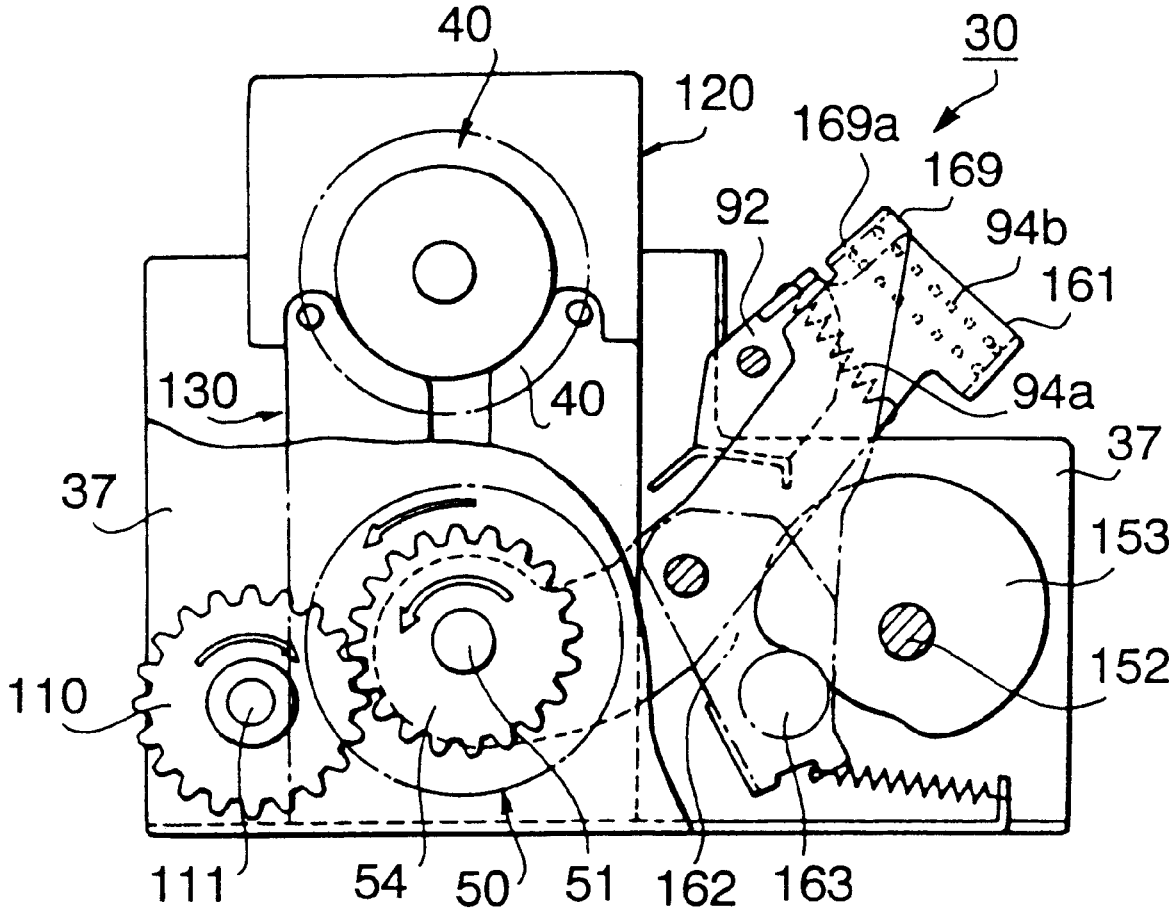
FIG. 7 is a sectional side view showing the fixing unit of FIG. 4.

FIG. 7 is a sectional side view showing the fixing unit 30. When the press roller 50 stays in the retracted position, the press roller gear 54 meshes with the assist gear 110. Thus, rotation of the assist gear 110 is transmitted to the press roller 50. A rotational direction of press roller 50 is identical with the recording sheet feeding direction as indicated by an arrow in FIG. 7.

In response to a rotation of the heat roller 40, the swing arm 161 is swung by the operation of electromagnetic clutch 151 (FIG. 5). The swing arm 161 moves the press roller 50 from the retracted position to the operating position. The press roller gear 54 is disengaged from the assist gear 110. The press roller 50 moves toward its operating position while keeping a continuous rotation due to inertia. Then, the press roller 50 is brought into contact with the recording sheet P, so that the recording sheet P is held between the heat roller and the press roller. In this case, the rotational speed of the assist gear 110 may be so set that the rotational speed of the press roller 50 (at a moment the recording sheet P is held between the press roller 50 and the heat roller 40) is substantially equal to the feeding speed of the recording sheet P. Thus, the recording sheet P is free from skew (which may occur if there is a significant speed difference between the recording sheet P and press roller 50) or jitter (which may occur if the recording sheet P significantly decelerates).

Since the one-way clutch 112 (FIG. 4) is provided between the transmission gear 113 and the support shaft 111, both of the support shaft 111 and the assist gear 110 can rotate only when the heat roller 40 rotates in the forward direction (clockwise in FIG. 6A).

As described above, according to the first embodiment, the press roller 50 reaches to the operating position while keeping its continuous rotation. Thus, skew or jitter can be prevented.

A second embodiment of the present invention is now described. In the second embodiment, rotation is provided to the press roller 50 by utilizing an upward movement of the press roller 50.

Figure 8:
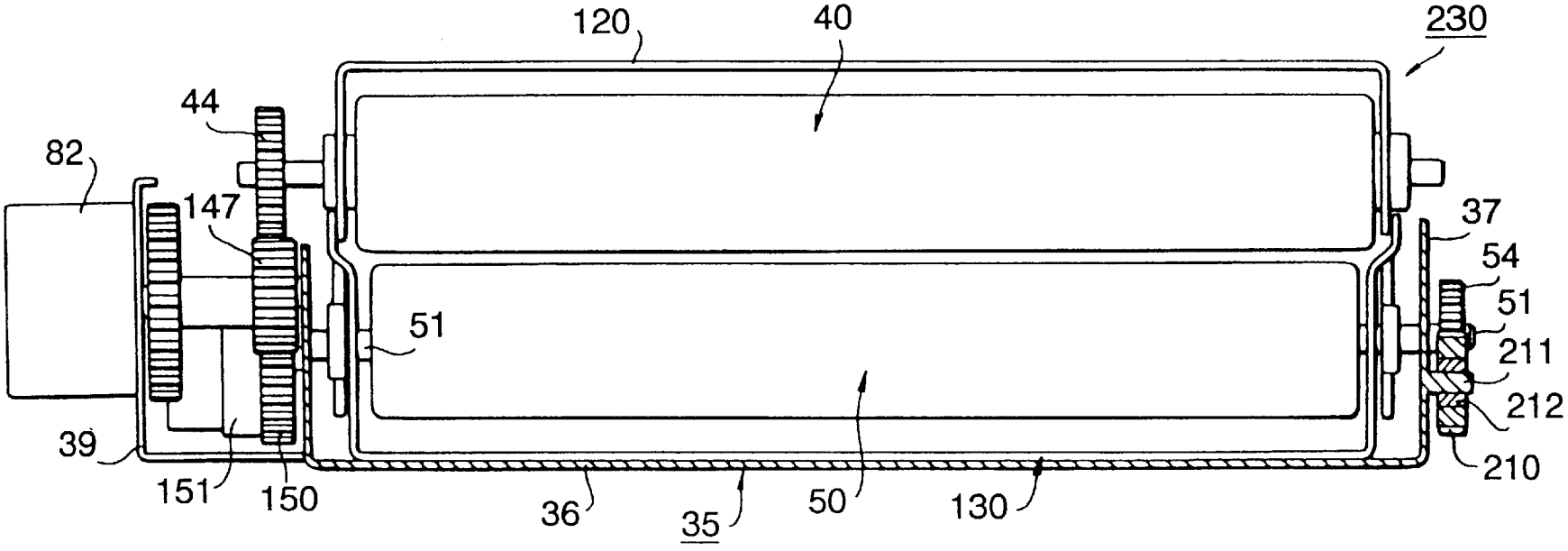
FIG. 8 is a sectional front view showing a fixing unit according to a second embodiment.

FIG. 8 is a front view of a fixing unit according to the second embodiment seen from the downstream side (left in FIG. 1). An assist gear 210 is supported on a support shaft 211 provided on the side plate 37, with a one-way clutch 212 provided between the support shaft 211 and the rotation-providing gear 210. When the press roller 50 is located at the retracted position, the assist gear 210 engages the press roller gear 54.

Figure 9A:
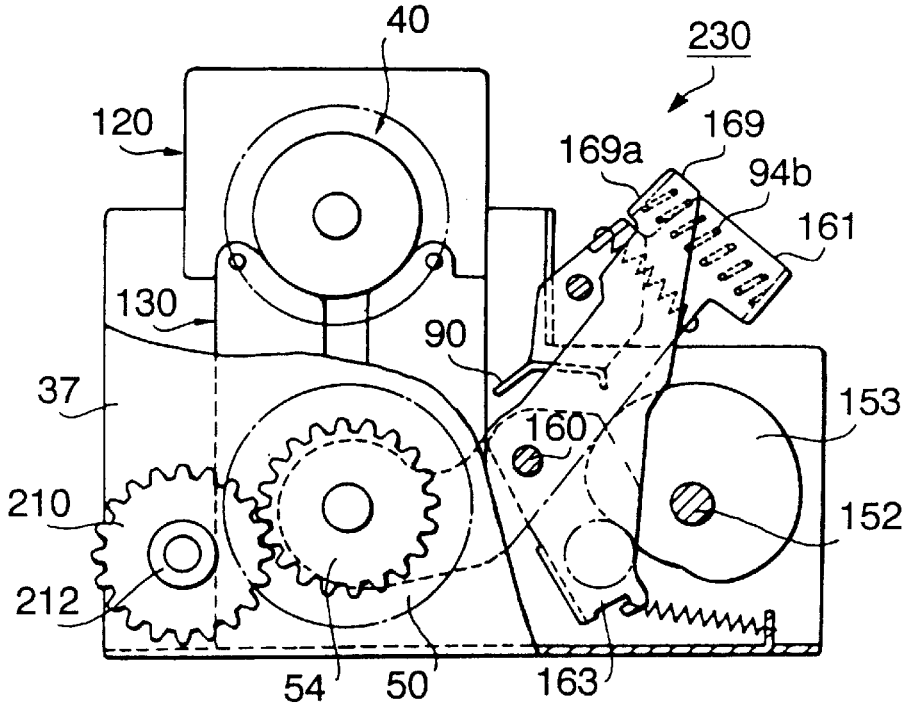
FIGS. 9A and 9B are sectional side views showing the fixing unit according to the second embodiment.
Figure 9B:
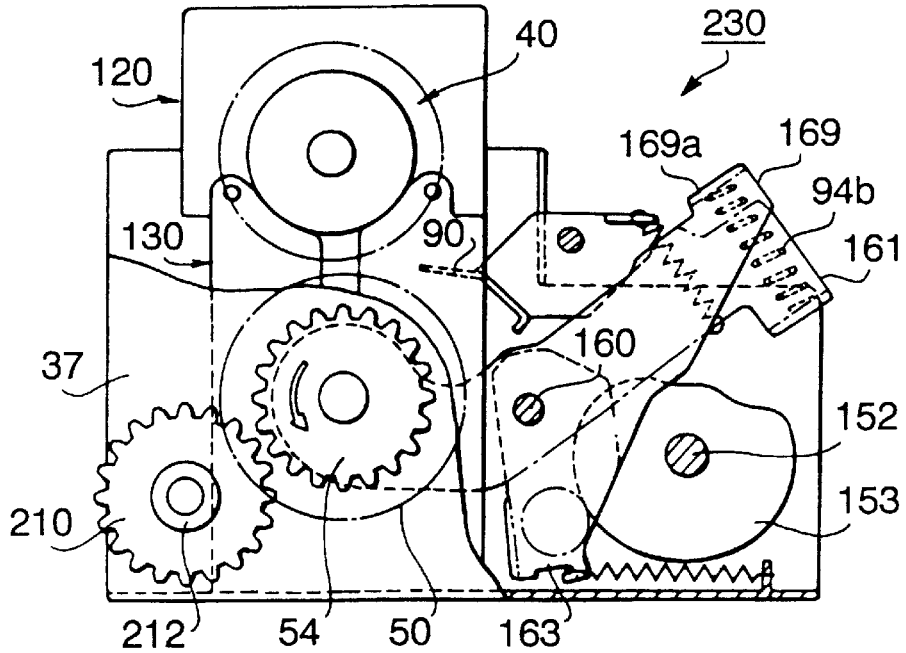

FIGS. 9A and 9B are sectional views showing the fixing unit 230. The assist gear 210 is supported so as to be rotatable only in a clockwise direction in FIGS. 9A and 9B. The second embodiment is different from the first embodiment in that no transmission is provided for rotating the rotation-providing gear 210. Other arrangements are substantially the same as those of the first embodiment.

When the fixing motor 82 (FIG. 8) starts the heat roller 40 starts rotating, while the press roller 50 does not rotate. Subsequently, the electromagnetic clutch 151 (FIG. 8) starts and the swing arm 161 begins its swing motion. Since the assist gear 210 does not rotate counterclockwise in FIG. 9B, the upward movement of the press roller 50 rotates the press roller gear 54 (and therefore the press roller 50) counterclockwise as shown by an arrow in FIG. 9B. Thus, the upward movement of the press roller 50 provides an initial rotation to the press roller 50. Then, the press roller 50 moves toward its operating position while keeping a continuous rotation due to inertia. When the press roller 50 moves from the operating position to the retracted position, the assist gear 210 is rotated in the clockwise direction, allowing the engagement with the press roller gear 54.

As described above, according to the second embodiment, the press roller 50 reaches to the operating position while rotating. Thus, the skew or jitter can be prevented. Further, since the upward movement of the press roller 50 is utilized to provide rotation to the press roller 50, the arrangement has a simple structure. The position of the assist gear 210 may be alternatively disposed at an intermediate position between the retracted position and the operating position of the press roller 50 so that the assist gear 210 can engage with the press roller gear 54 from the retracted position to the operating position.

A third embodiment of the present invention is now described. In the third embodiment, rotation is provided to the press roller 50 by utilizing assist rollers, instead of the assist gear of the first and second embodiments.

Figure 10:
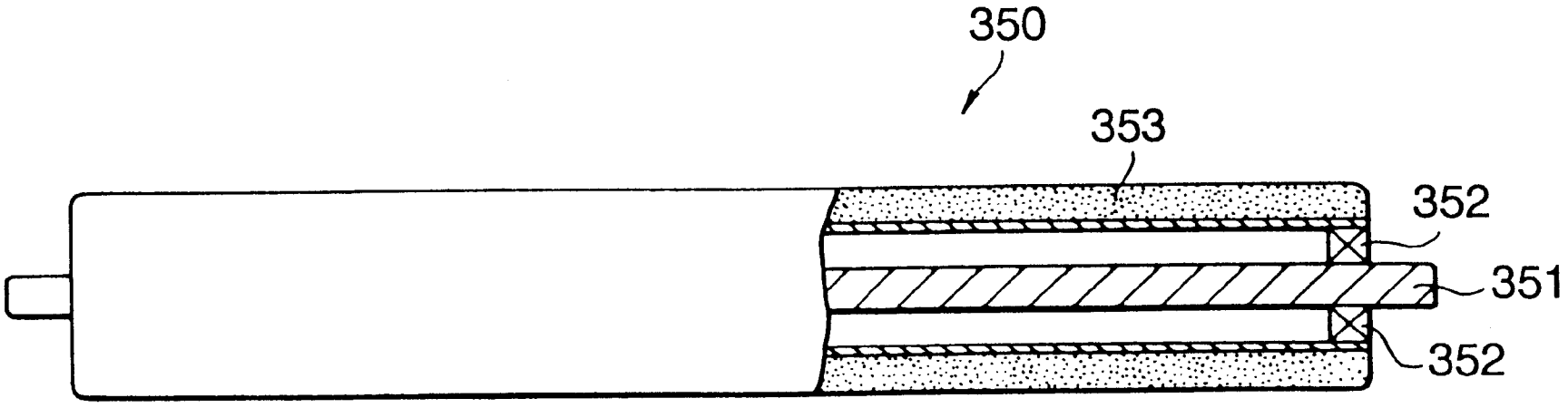
FIG. 10 is a partial cutaway view showing a press roller.

FIG. 10 shows a press roller 350 used in a fixing unit 330 of the third embodiment. The press roller 350 includes a center shaft 351, a cylindrical body 353 rotatable about the center shaft 351, and a radial bearing 352 interposed between the center shaft 351 and the cylindrical body 353. The surface of the cylindrical body 353 is covered by an elastic member such as rubber.

Figure 11:
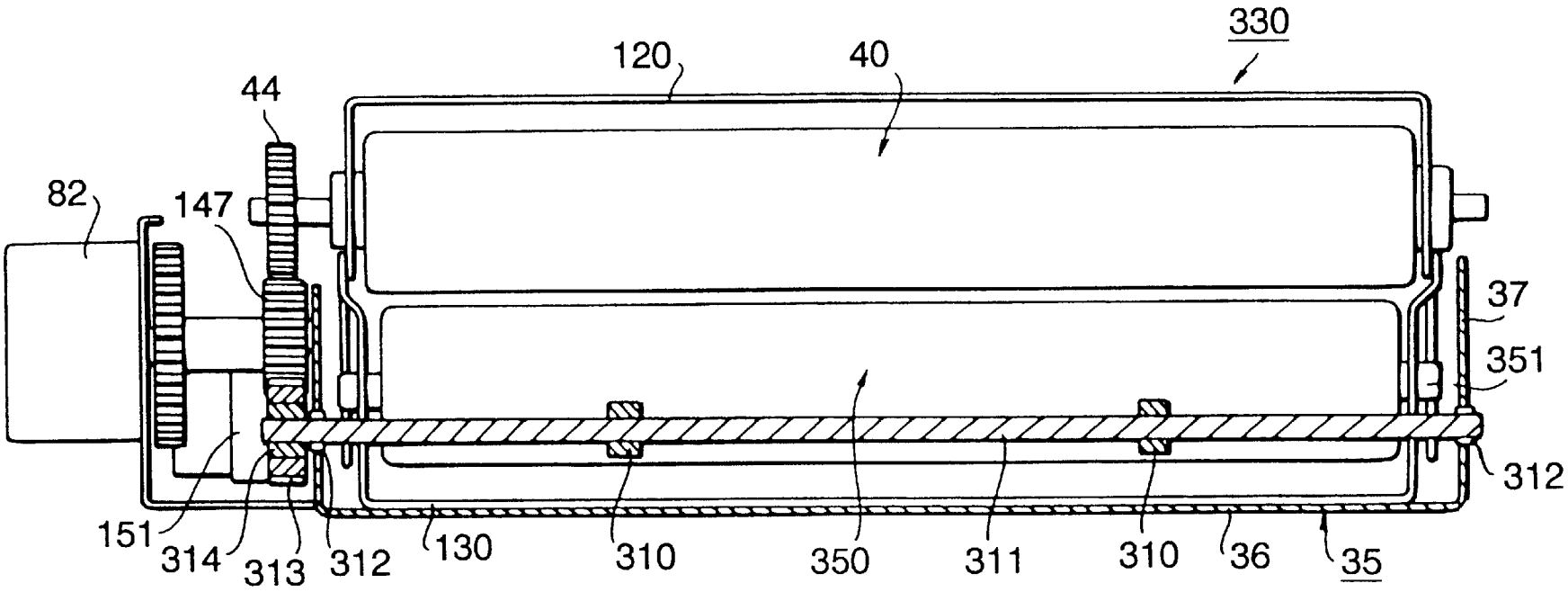
FIG. 11 is a sectional front view showing the fixing unit according to a third embodiment.

FIG. 11 is a sectional view showing the fixing unit 330 of the third embodiment, seen from the downstream side (left in FIG. 1). A pair of assist rollers 310 are mounted on a support shaft 311 provided at the downstream side of the press roller 350. These assist rollers 310 are in contact with the surface of the press roller 350 being positioned at its retracted position. Both ends of the support shaft 311 are rotatably supported by bearings 312 provided on the opposed side plates 37. One end of the support shaft 311, adjacent to the fixing roller 82, is provided with a transmission gear 313 with a one-way clutch 314 interposed between the support shaft 311 and the transmission gear 313. The transmission gear 313 meshes with the third gear 147, so that the rotation of the fixing motor 82 is transmitted to the assist rollers 310.

Figure 12:
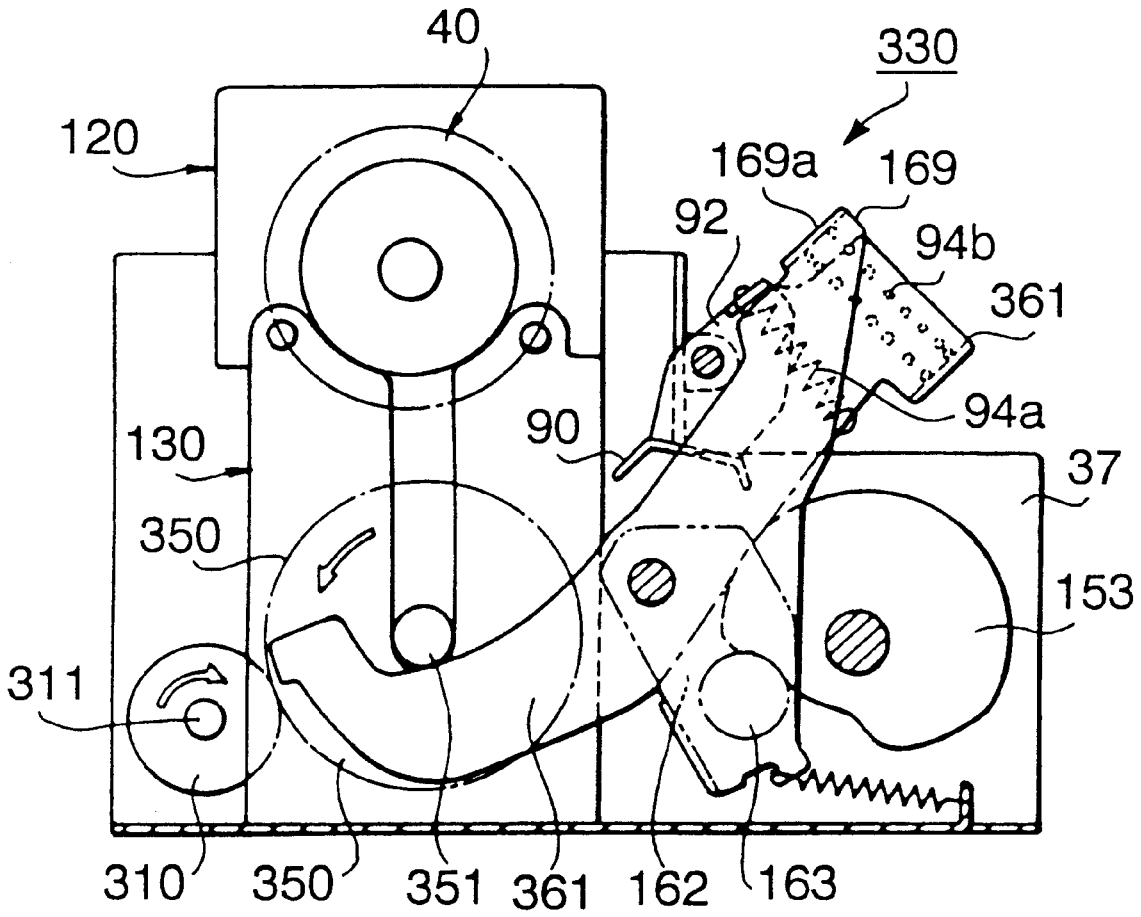
FIG. 12 is a sectional side view showing the fixing unit according to the third embodiment.

FIG. 12 is a sectional side view showing the fixing unit 330 of the third embodiment. The swing arm 361 is constructed to contact the lower part of the center shaft 351 and raise it upward. Other arrangements are substantially the same as those disclosed in the first embodiment.

The assist rollers 310 contact the surface of the press roller 350 when the press roller 350 is positioned at the retracted position. The assist roller 310 is rotated clockwise in FIG. 12. Accordingly, the press roller 350 is rotated counterclockwise (shown by an arrow in FIG. 12) by the contact between the press roller 350 and the assist rollers 310.

In response to the rotation of the heat roller 40, a swing arm 361 is swung upward by the operation of electromagnetic clutch 151 (FIG. 11) and the press roller 350 is moved upward toward the operating position while rotating due to inertia. Then, the press roller 350 is brought into contact with the recording sheet P. In this case, the rotational speed of the assist rollers 310 may be set so that the rotational speed of the press roller 350 (at a moment the press roller 350 and the heat roller 40 sandwich the recording sheet P) is substantially equal to the feeding speed of the recording sheet P.

Thus, according to the third embodiment, the press roller 350 reaches to the operating position while keeping its continuous rotation. Therefore, the skew or jitter can be prevented.

A fourth embodiment of the present invention is now described. In the fourth embodiment, rotation is provided to the press roller 350 by an upward movement of the press roller 350.

Figure 13:
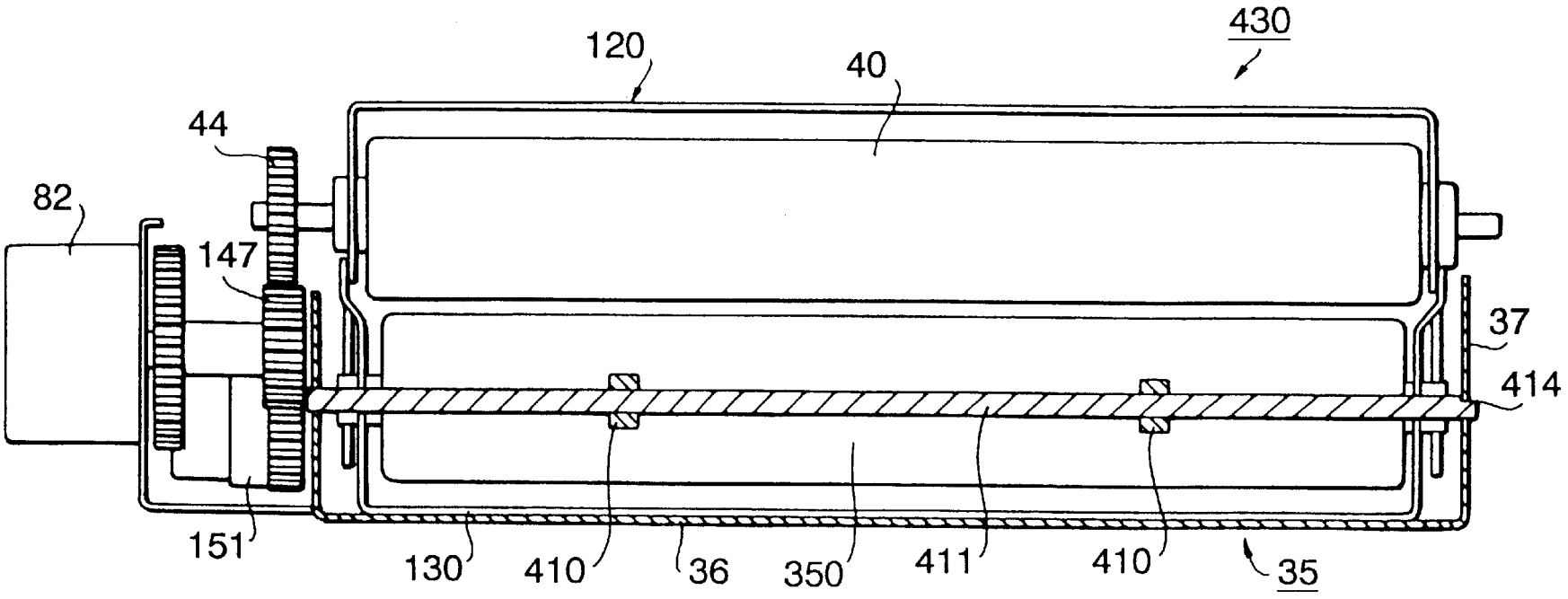
FIG. 13 is a sectional front view showing a fixing unit according to a fourth embodiment.

FIG. 13 is a sectional view showing a fixing unit 430 of the fourth embodiment, seen from the downstream side (left in FIG. 1). A pair of assist rollers 410 are mounted on a support shaft 411. These assist rollers 410 are in contact with the surface of the press roller 350 when the press roller 350 is located at its retracted position. Both ends of the shaft 411 are fixed to the opposed side plates 37. In order to prevent the support shaft 411 from rotating, one end of support shaft 411 is partially cut away and locked by a D-shaped hole 414 formed on the side plate 37. Other arrangements are substantially the same as those in the third embodiment.

Figure 14A:
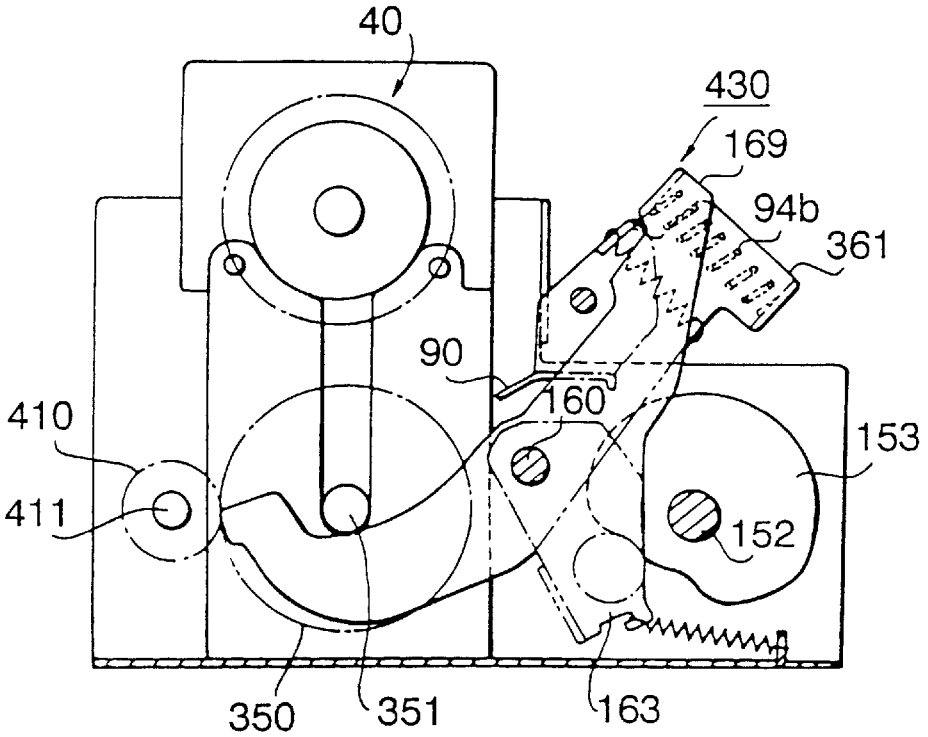
FIGS. 14A and 14B are sectional side views showing the fixing unit according to the fourth embodiment.
Figure 14B:
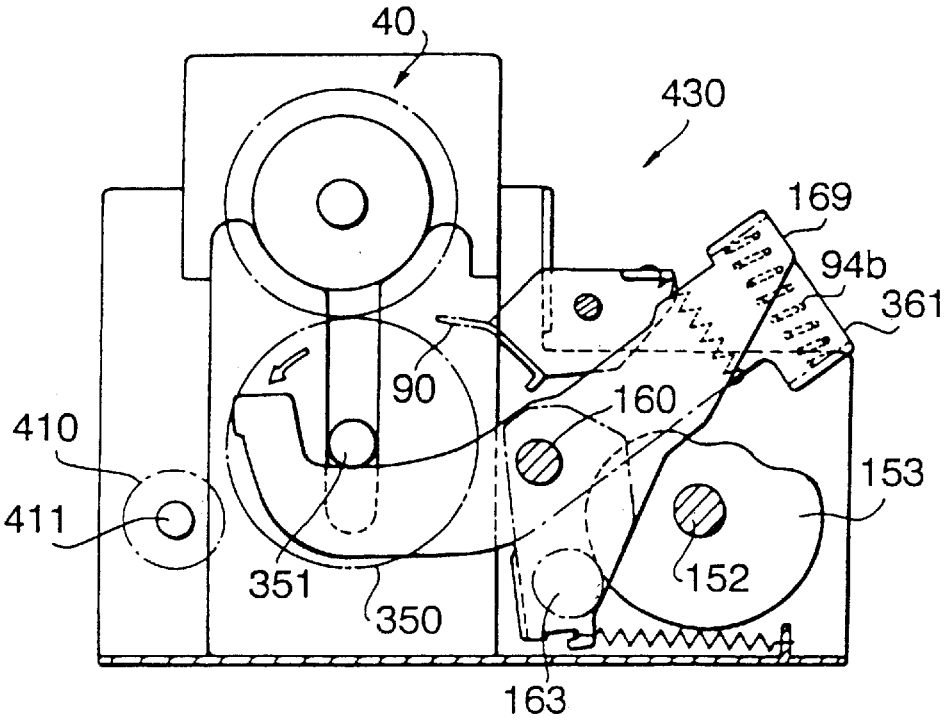

FIGS. 14A and 14B are sectional views showing the fixing unit 430 of the fourth embodiment. In response to rotation of the heat roller 40, the swing arm 361 is swung by electromagnetic clutch 151 (FIG. 11). Press roller 350 moves upward from the retracted position. Then, due to the tangential contact between the press roller 350 and the assist rollers 410, the press roller 350 is forcibly rotated 410 counterclockwise (shown by an arrow in FIG. 14B). That is, the upward movement of the press roller 350 provides rotation to the press roller 350. With this, the press roller 350 moves to and reaches the operating position while keeping a continuous rotation. Thus, the recording sheet P is free from the skew or jitter.

The position of the assist roller 410 may be disposed at any position as long as the press roller 350 tangentially contacts the assist roller 410 from the retracted position to the operating position.

As described above, according to the third embodiment, the press roller 350 reaches to the operating position while rotating. Thus, the skew or jitter can be prevented. Further, since the upward movement of the press roller 350 is used to give an initial rotation speed to the press roller 350, the arrangement becomes simple.

A fifth embodiment of the present invention is now described. In the fifth embodiment, rotation is provided to the press roller 350 by utilizing the slide arm 23 (FIG. 1) used for retracting the corona charger 19 in the transfer unit 20.

Figure 15:
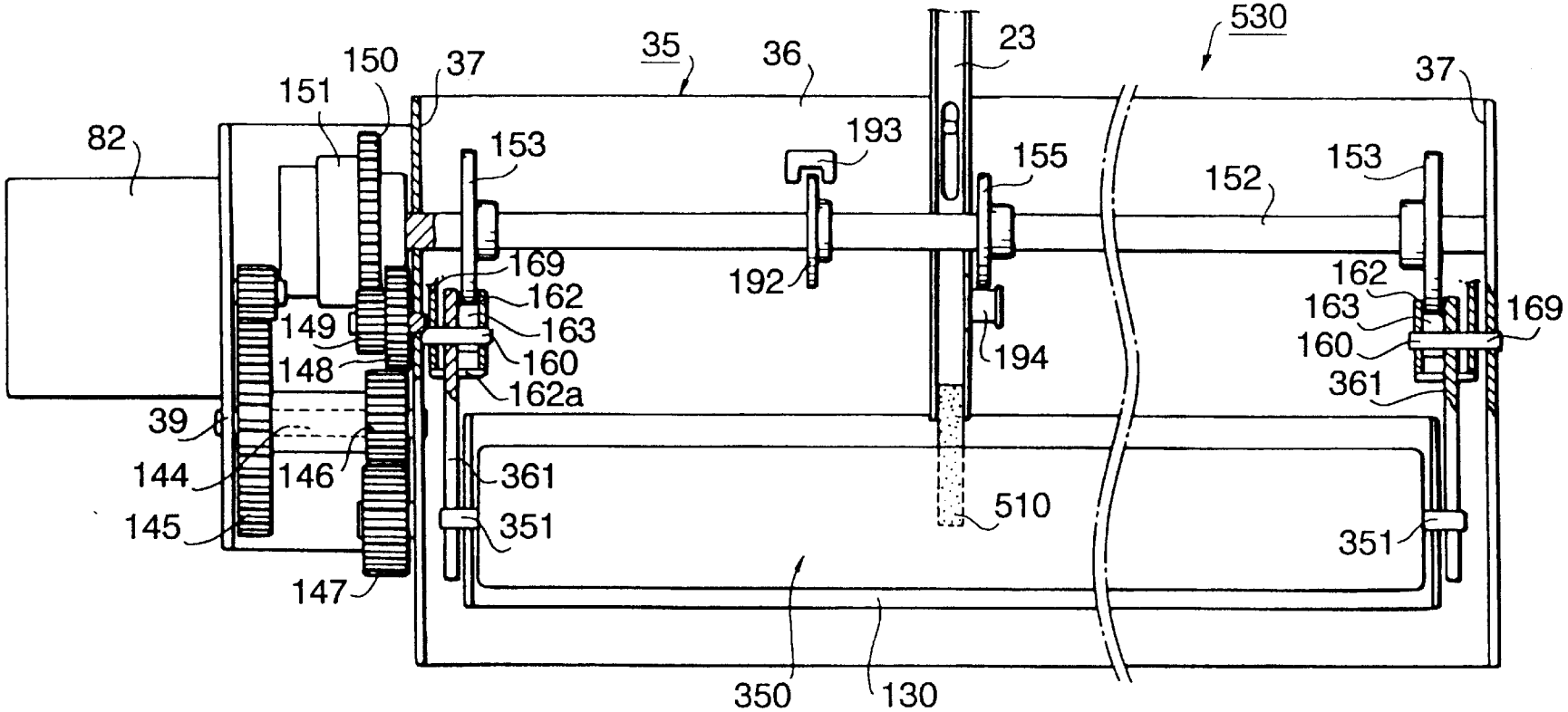
FIG. 15 is a sectional plan view showing a fixing unit according to a fifth embodiment.

FIG. 15 is a plan view of a fixing unit 530 of the fifth embodiment. As described above, the cam follower 194 is provided on the end of the slide arm 23. The cam follower 194 is brought into contact with second disk cam 155, so that the rotation of the cam shaft 152 is converted into reciprocal slide motion of slide arm 23.

The slide arm 23 is provided with a rubber abutting member 510 at the downstream end of the recording sheet feeding direction. This rubber abutting member 510 is brought into contact with the lowermost end of press roller 350 located at the retracted position. Other arrangements are substantially the same as those disclosed in the fourth embodiment.

A rotation of the heat roller 40 is transmitted to the cam shaft 152 via first to sixth gears 145–149 by an operation of the electromagnetic clutch 151. The rotation of cam shaft 152 is converted to a swing motion of swing arm 361. In response to the swing motion of swing arm 361, the press roller 350 is moved toward the operating position. At the same time, by the engagement of the second disk cam 155 engages with cam follower 194, the slide arm 23 is moved toward the upstream side (i.e., from the bottom to top in FIG. 15) and moves the corona charger 19 (FIG. 1) to the operating position.

Figure 16:
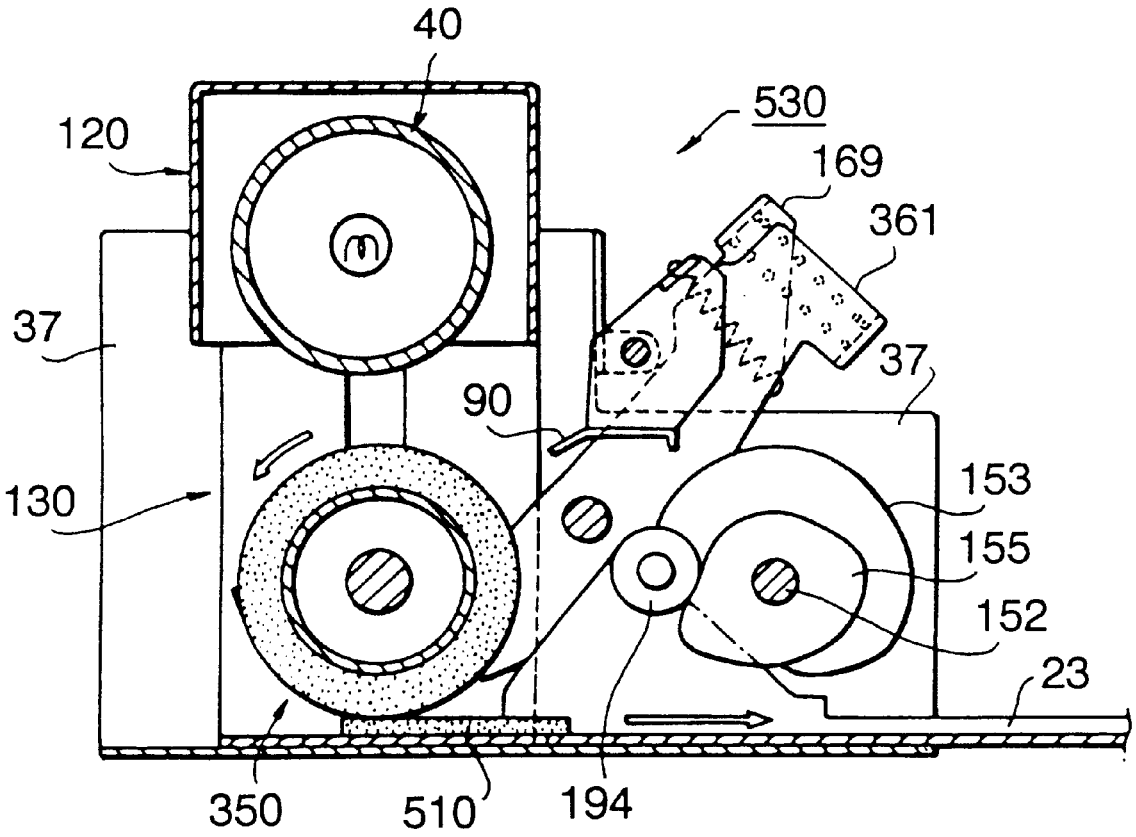
FIG. 16 is a sectional side view showing the fixing unit according to the fifth embodiment.

FIG. 16 is a sectional side view showing fixing unit 530. When slide arm 23 moves toward the upstream side (i.e., from left to right in FIG. 16), the abutting member 510 contacts the press roller 350 to rotate the press roller 350 in the counterclockwise direction (as shown by an arrow in FIG. 16). Thus, the press roller 350 reaches the operating position while rotating due to inertia. Thus, skew and jitter can be prevented. Further, the fifth embodiment is advantageous in that it needs no other special arrangement than the abutting member 510 and therefore the number of components can be decreased.

A sixth embodiment of the present invention is described. In the sixth embodiment, rotation is provided to the press roller by utilizing a cooling fan for cooling the press roller.

Figure 17:
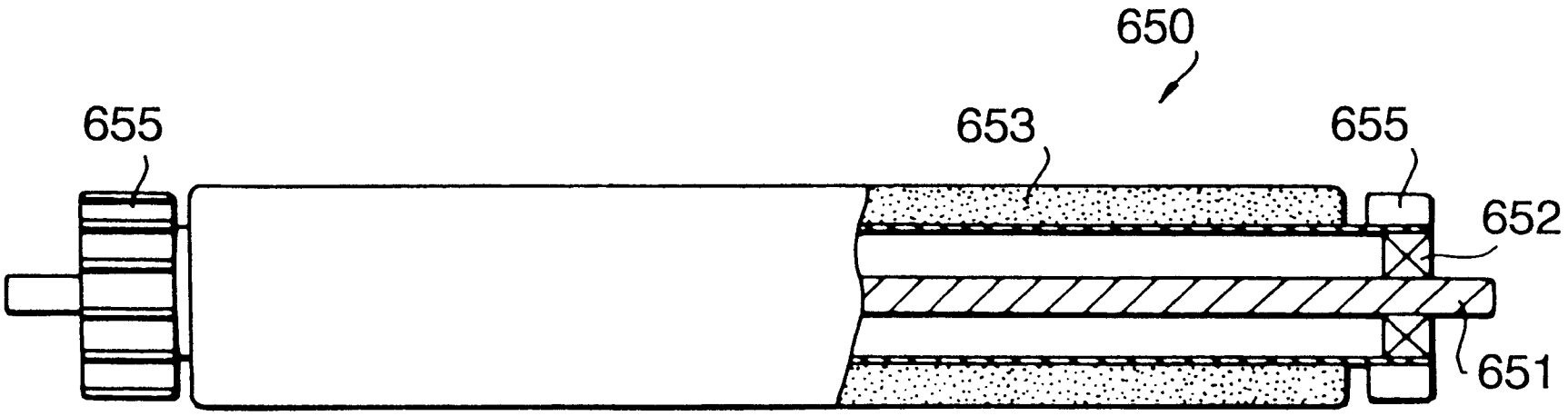
FIG. 17 is a partial cutaway view showing an arrangement of a press roller of a fixing unit according to a sixth embodiment.

FIG. 17 is a partial cutaway view of a press roller 650 in a fixing unit 630 of the sixth embodiment. The press roller 650 includes a center support shaft 651, a cylindrical body 653, and a radial bearing 652 rotatably supporting the cylindrical body 653 about shaft 651. The press roller 650 is further provided with impellers 655 on the axial ends of cylindrical body 653.

Figure 18:
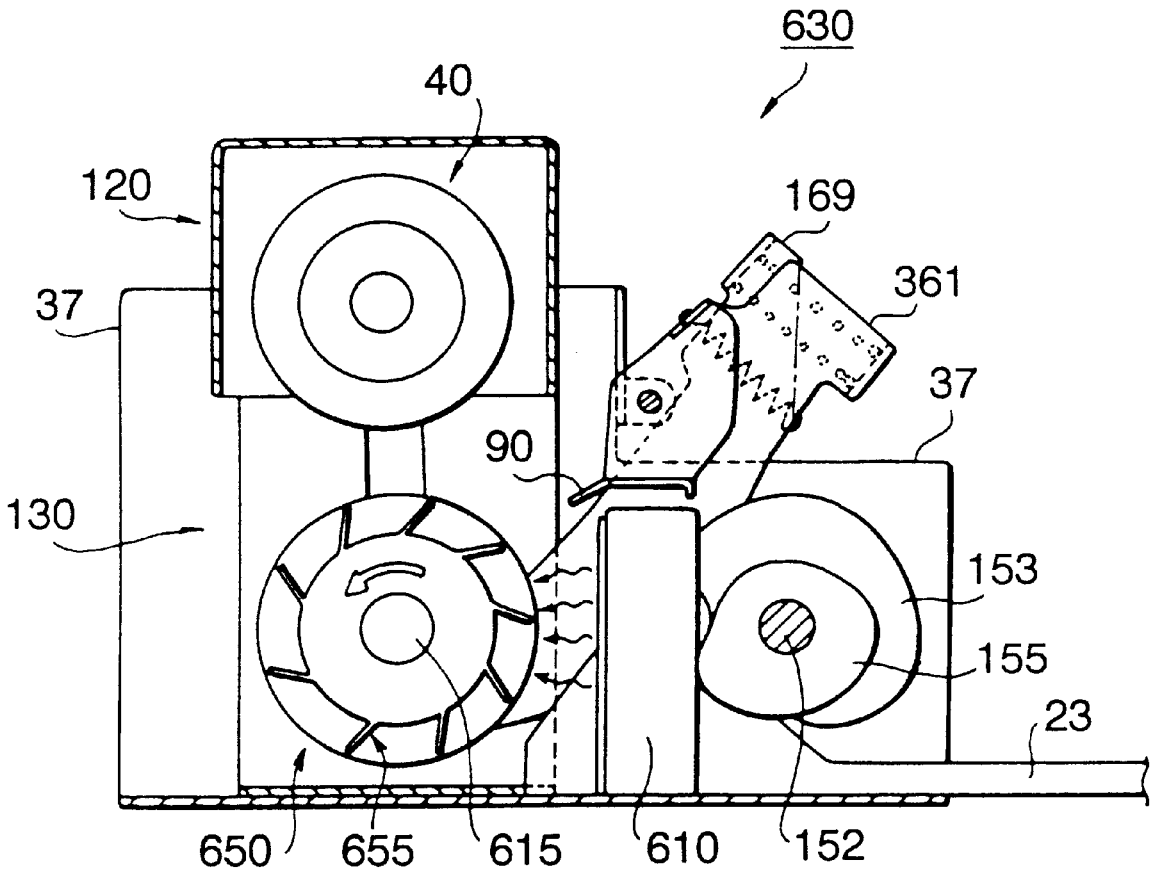
FIG. 18 is a sectional side view showing the fixing unit in accordance with the sixth embodiment.

FIG. 18 is a sectional side view of the fixing unit 630. In order to supply cooling air to the press roller 650, a fan 610 is provided at the upstream side (right in FIG. 18) of press roller 650. The impellers 655 receive the cooling air fed from the fan 610 and rotate counterclockwise (as shown by an arrow in FIG. 18).

According to the arrangement of the sixth embodiment, the press roller 650 moves toward the operating position while rotating by receiving air supplied from fan 610. Thus, the recording sheet P is free from the skew or jitter. The sixth embodiment is advantageous in that, during the operation of fan 610, the press roller 650 is uniformly cooled down because the press roller 650 is always rotating when the press roller 650 is located in the retracted position.

In the first to sixth embodiments of the present invention, the peripheral speed of the press roller can be optimized in the following manner. In order to effectively prevent skew or jitter, the peripheral speed of the press roller (at a moment immediately before the press contacts the recording sheet P) should not be too slow or too fast, compared with the peripheral speed of the heat roller (same as the feeding speed of the recording sheet P). In view of the above, an optimum peripheral speed of the press roller (at a moment immediately before the press contacts the recording sheet P) relative to the peripheral speed of the heat roller is in a range of −50% to +50%, preferably −20% to +20%.

The following table 1 shows an experimental result.

TABLE 1

| Peripheral Speed of Press Roller | Skew | Jitter |
|---|---|---|
| −60% | ○ | Δ |
| −40% | ○ | ○ |
| −20% | ⊙ | ⊙ |
| 0% | ⊙ | ⊙ |
| +20% | ⊙ | ⊙ |
| +40% | ○ | ○ |
| +60% | ○ | X |

In table 1, the peripheral speed of the press roller (at a moment immediately before the press contacts the recording sheet P) is expressed relative to the peripheral speed of the heat roller. Marks used in table 1 indicates the effects in suppressing the skew and jitter, wherein ⊙ is excellent; ○ is good; Δ is acceptable; and X is unacceptable (sheet jam).

Figure 19:
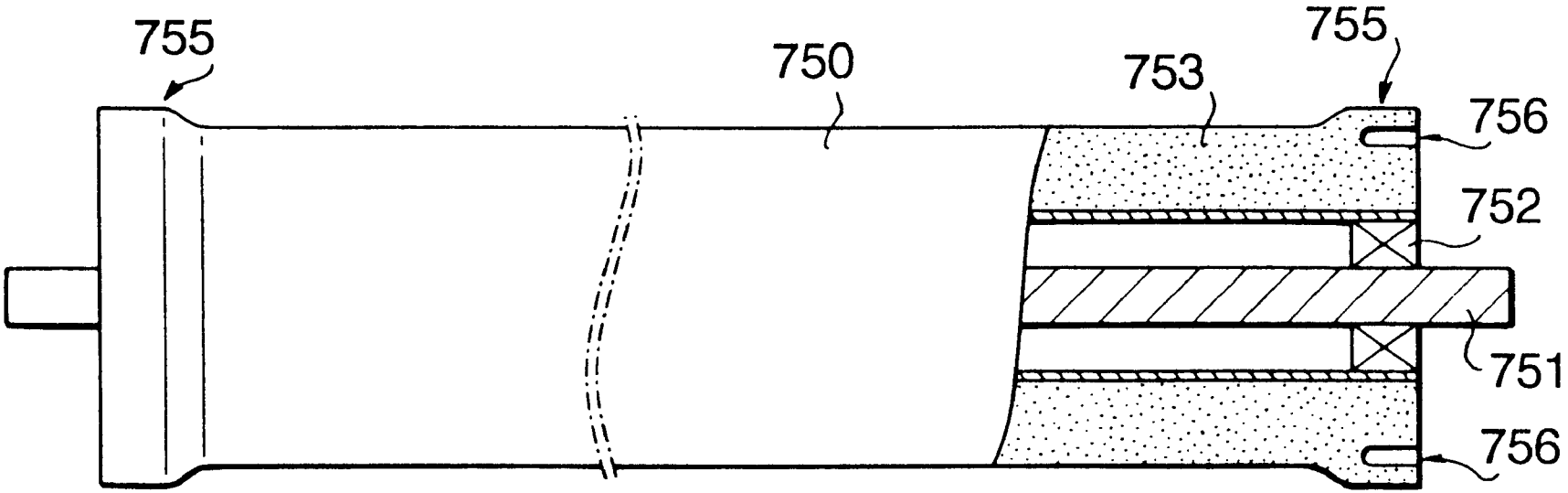
FIG. 19 is a partial cutaway view a press roller of the fixing unit according to the seventh embodiment.

A seventh embodiment of the present invention is described. FIG. 19 is a partial cutaway view showing a press roller 750 of the seventh embodiment. The press roller 750 includes a support shaft 751 and a cylindrical body 753 rotatably supported by the support shaft 751 via bearings 752. The cylindrical body 753 is formed such that both axial ends (end portions 755) thereof are large in diameter than that of the remaining portions. A distance between these end portions 755 is larger than a width of the recording sheet P. A difference in diameter of the end portion 755 and the remaining portion of the press roller 750 (i.e., an intermediate portion between end portions 755) is larger than the thickness of the recording sheet P. A hollow space 756 is formed in each end portion 755, so that the end portion 755 is easily deformed when the press roller 750 is pressed against heat roller 40. In the seventh embodiment, the axial length of each end portion 755 is approximately 5 mm while the axial length of the cylindrical body 753 is 270 mm. The width of the recording sheet P is 254 mm. The outer diameter of end portion 755 is 2 to 5 mm larger than the outer diameter (40 mm) of the remaining portions of the cylindrical body 753.

Figure 20:
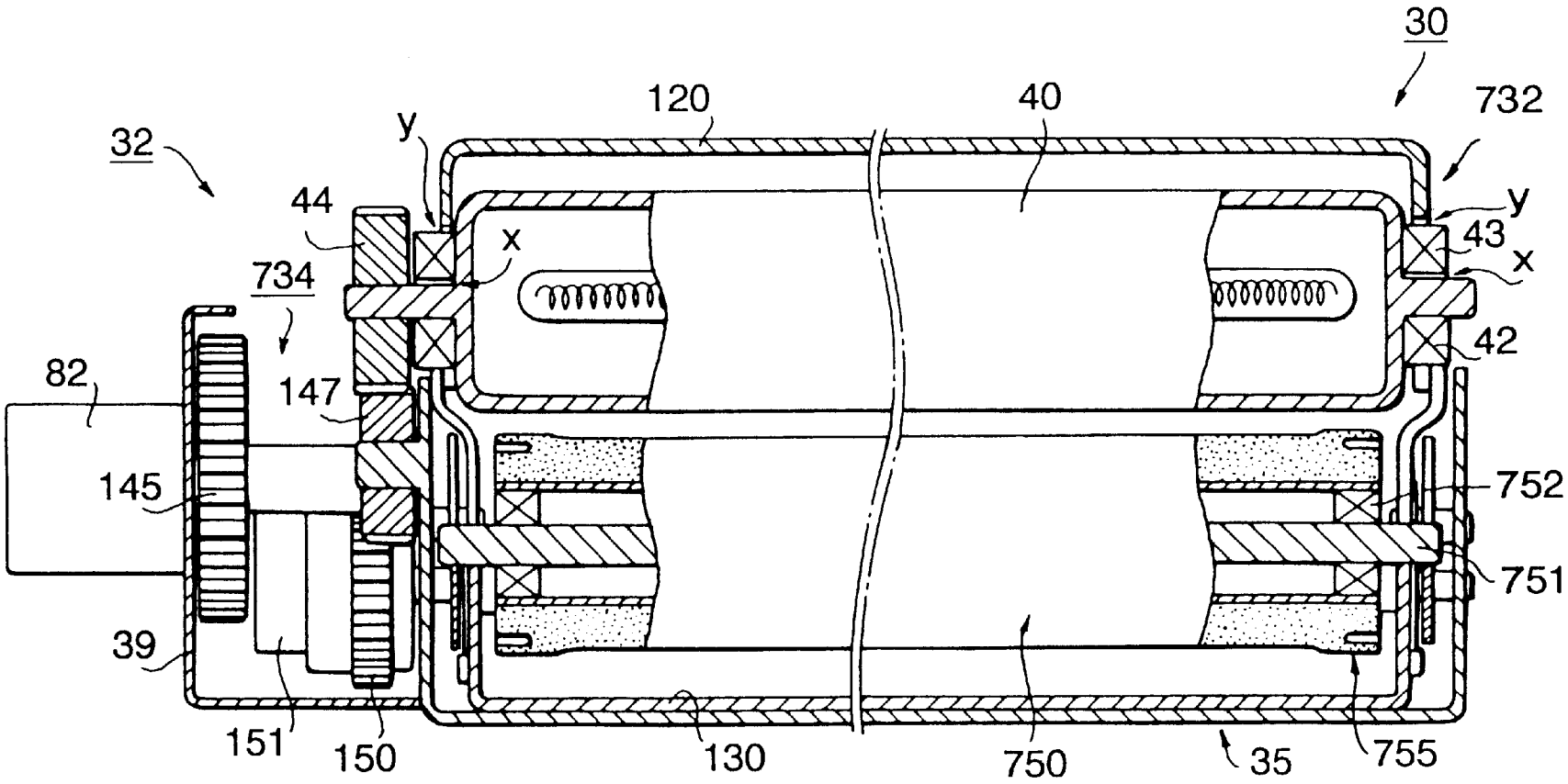
FIG. 20 is a sectional front view showing the fixing unit shown in FIG. 19.

FIG. 20 is a sectional view of the fixing unit 730, seen from the downstream side (left in FIG. 1). In the fixing unit 730 of the seventh embodiment, the assist gear 110, the support shaft 111 and the transmission gear 113 (as in the first embodiment) are not provided. Other arrangements are substantially the same as those in the first embodiment. After the heating of the heat roller 40 is started, the temperature of the heat roller 40 increases first. Next, the temperature of the bearing 43 increases. Finally, the temperature of the upper frame 120 increases. Accordingly, in order to allow the thermal expansion of the support shaft 42 preceding that of the bearing 43, a clearance "x" is provided between the support shaft 42 and the-bearing 43. Further, in order to allow the thermal expansion of the bearing 43 preceding that of the upper frame 120, a clearance "y" is provided between the bearing 43 and the upper frame 120.

Figure 21A:
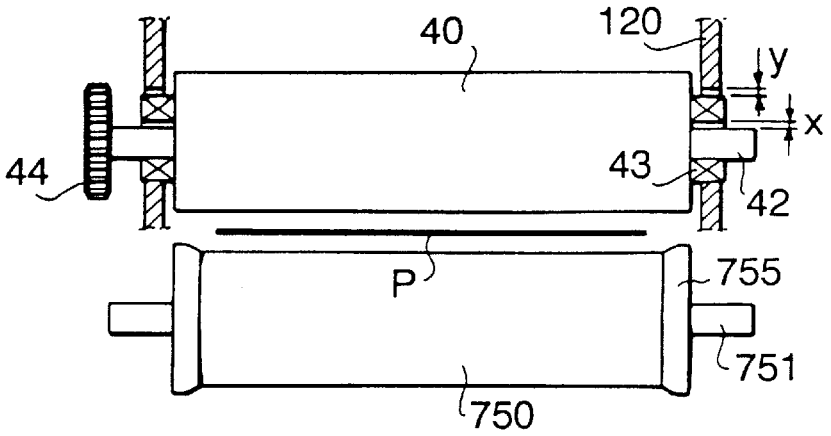
FIGS. 21A to 21D are schematic views illustrating a closing process of the press roller and the heat roller of the fixing unit according to the seventh embodiment.

FIGS. 21A to 21D are sequential illustrations showing the heat roller 40 and the press roller 750. In FIG. 21A, heat roller 40 is not rotated and the press roller 750 is located at the retracted position.

Figure 21B:
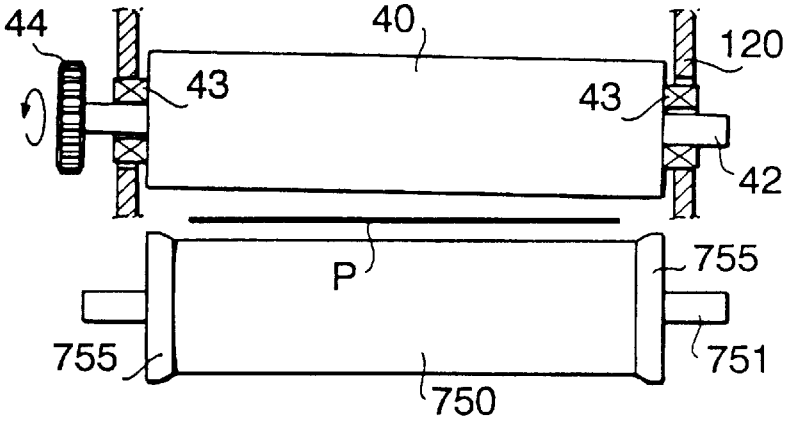

As shown in FIG. 21B, when the roller gear 44 of the heat roller 40 is driven, the roller gear 44 is biased upward by the force caused by the engagement between third gear 147

(FIG. 20) and the roller gear 44. One end (to which the roller gear 44 is provided) of heat roller 40 is lifted by an amount equivalent to a sum of the above-described clearances "x" and "y" (i.e., x+y). Thus, heat roller 40 is inclined as shown in FIG. 21B.

Figure 21C:
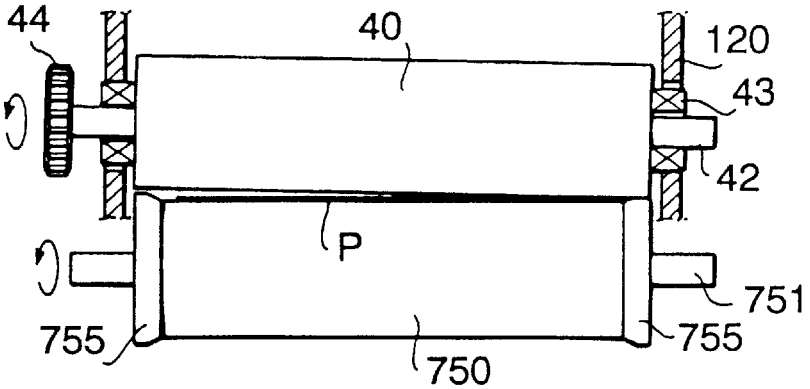

Then, the press roller 50 is moved toward the operating position. Then, as shown in FIG. 21C, the end portion 755 of the press roller 50 is brought into contact with the surface of heat roller 40 first. A rotation of the heat roller 40 is transmitted to the press roller 50 via the end portion 55. Thus, the press roller 50 starts rotating in accordance with a rotation of the heat roller 40.

Figure 21D:
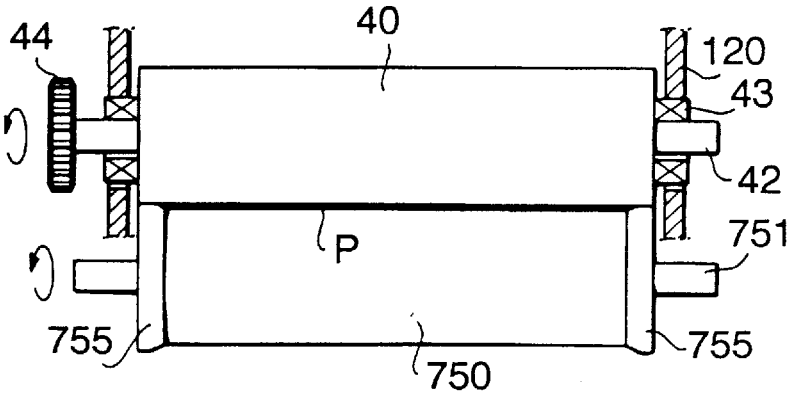

Then, as shown in FIG. 21D, the press roller 750 is further moved to and reaches to the operating position. In this stage, both end portions 755 are brought into contact with the surface of the heat roller 40. The heat roller 40 is pushed upward by the end portions 55. Thus, the other end (the right end of FIG. 21D) of the heat roller 40 is raised upward by an amount equivalent to the summed clearance (x+y) as shown in FIG. 21D, before the recording sheet P is held between the heat roller 40 the press roller 50.

As constructed above, according to the seventh embodiment, at a moment the recording sheet P is held between the heat roller 40 and the press roller 50, the press roller 50 is rotating due to a preceding contact between the end portion 755 and the heat roller 40. Thus, the occurrence of skew and jitter can be prevented. Further, at the moment the recording sheet P is held between the heat roller 40 and the press roller 50, the heat roller 40 is substantially parallel with the press roller 50. Thus, the recording sheet p is uniformly pressed by the press roller 50, which further prevents the occurrence of jitter.

Figure 22:
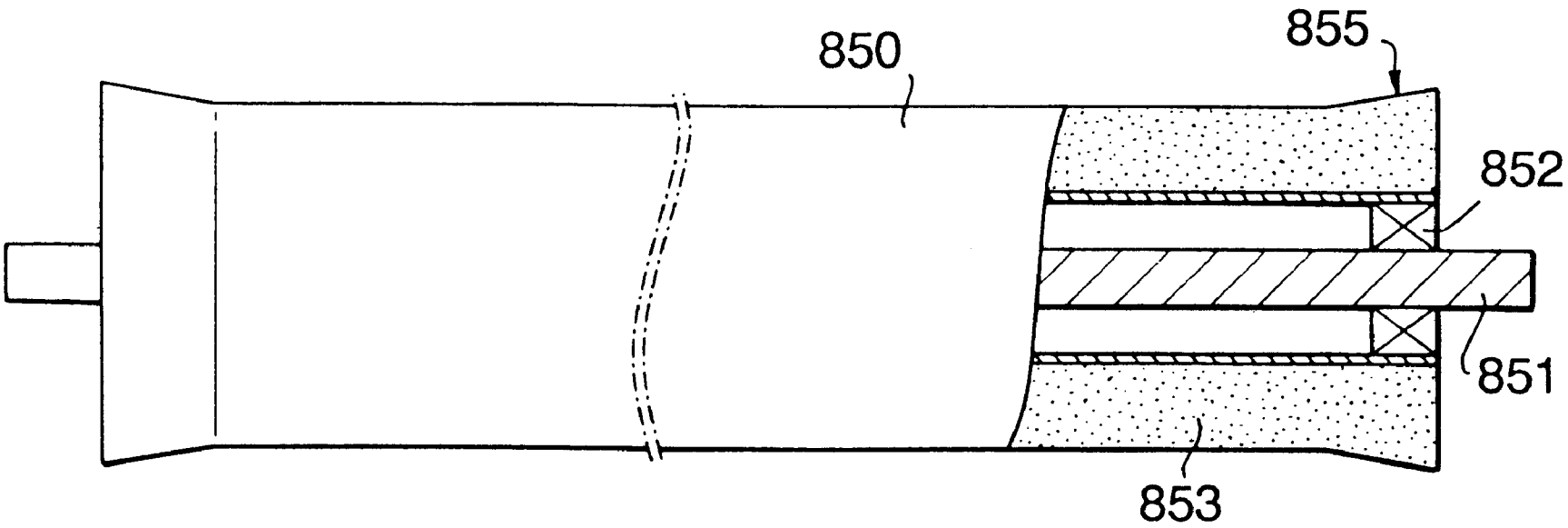
FIG. 22 is a partial cutaway view showing an arrangement of a modified press roller of the fixing unit according to the seventh embodiment.

FIG. 22 shows a modified structure of the press roller of the seventh embodiment. A press roller 850 according to the modification includes a support shaft 851 and a cylindrical body 853 rotatably supported by the support shaft 851 via bearings 852. The cylindrical body 853 is formed such that both axial ends (end portions 855) thereof are larger in diameter than that of the remaining portions. A distance between these end portions 855 is larger than a width of the recording sheet P. A difference in diameter of the end portion 855 and the remaining portion of the press roller 850 (i.e., an intermediate portion between end portions 855) is larger than the thickness of the recording sheet P. Each axial end of the cylindrical body 853 is formed into an end portions 855 that is tapered to have a diameter increasing linearly toward the outermost end. In other words, each end portions 855 has a shape similar to the bottom portion of a cone.

An eighth embodiment of the present invention is described with reference to FIG. 23A to 23C.

Figure 23A:
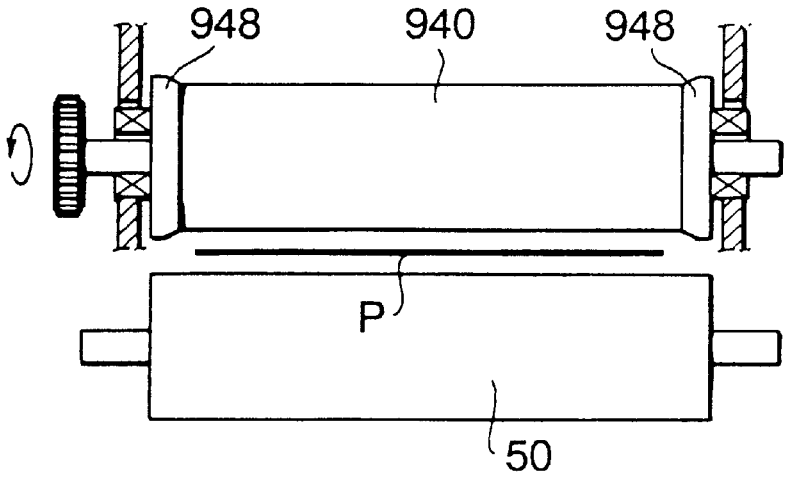
FIGS. 23A to 23C are schematic views illustrating closing process of the press roller and the heat roller of a fixing unit according to an eighth embodiment.

According to the eighth embodiment, as shown in FIG. 23A, the heat roller 940 is formed such that both axial ends (end portions 948) thereof are larger in diameter than that of the remaining portions. The press roller 50 is same as that of the first embodiment. Other arrangements are the same as that of the seventh embodiment.

Figure 23B:
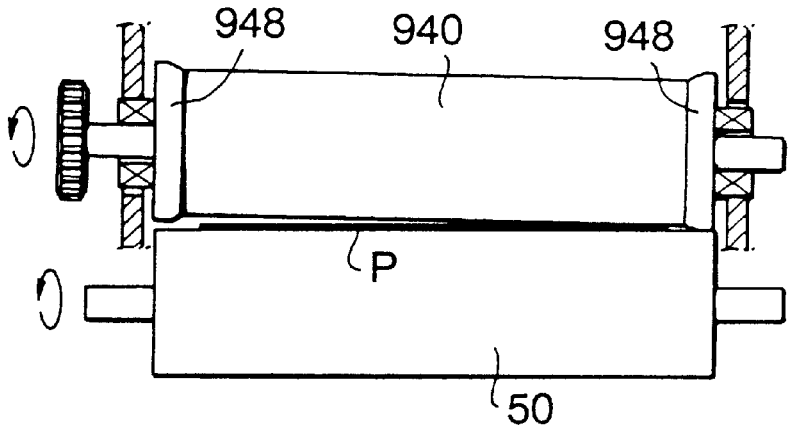
Figure 23C:
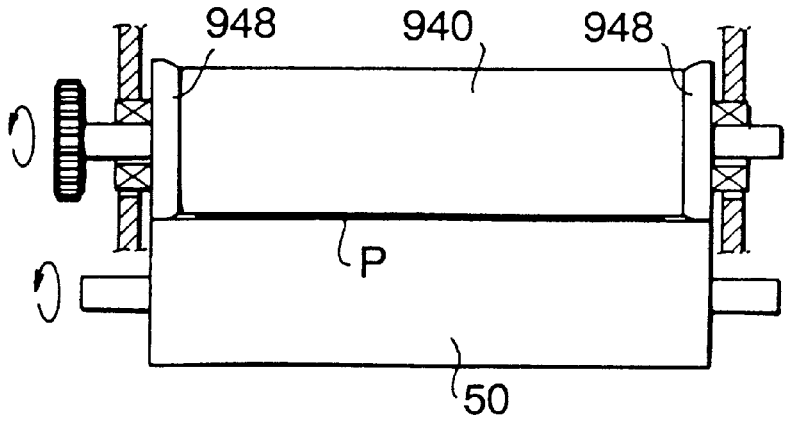

As shown in FIG. 23B, when the press roller 50 moves toward the heat roller 940, the press roller 50 contacts one of the end portions 948 of the heat roller 940. Thus, the rotation of the heat roller 940 is transmitted to the heat roller 940. When the press roller 50 is further moved upward, the press roller 50 contacts both end portions 948 and biases them upward, which make the heat roller 350 parallel to the press roller 50. Then, the recording sheet P is held between the heat roller 340 and the press roller 350 being paralleled with each other, as shown in FIG. 24C.

According to the eighth embodiment, at a moment the recording sheet P is held between the heat roller 40 and the press roller 50, the press roller 50 is rotating. Further, the heat roller 40 and the press roller 50 are substantially parallel with each other. Thus, the occurrence of jitter and skew can be prevented.

Although the structure and operation of a fixing unit is described herein with respect to the preferred embodiments, many modifications and changes can be made without departing from the spirit and scope of the invention.

The present disclosure relates to subject matter contained in Japanese Patent Application Nos. HEI 08-205239 filed on Jul. 16, 1996, HEI 08-216801 filed on Jul. 30, 1996, which are expressly incorporated herein by reference in its entirety.

What is claimed is:

1. A fixing unit for fixing images on a recording sheet, comprising:

a heat roller accommodating a heater;

a press roller for pressing a recording sheet towards said heat roller;

a moving mechanism which opens and closes a gap between said press roller and said heat roller, said recording sheet being pressed by said heat roller and said press roller when said moving mechanism closes said gap;

a rotating mechanism which rotates said heat roller; and a rotation-providing mechanism which rotates said press roller so that said press roller is rotating when said moving mechanism is closing said gap.

2. The fixing unit according to claim 1, wherein said press roller is movable between an operating position where said press roller and said heat roller sandwich said recording sheet and a retracted position where said press roller is retracted from said operating position, and wherein said moving mechanism moves said press roller between said retracted position and said operating position.

3. The fixing unit according to claim 1, wherein said rotation-providing mechanism comprises a driven gear provided to said press roller and a driving gear that engages said driven gear when said press roller is positioned at a retracted position.

4. The fixing unit according to claim 3, further comprising a transmission mechanism which transmits the rotation of said rotation mechanism to said driving gear.

5. The fixing unit according to claim 3, wherein said driven gear is rotated by movement of said driven gear with respect to said driving gear, caused by the movement of said press roller from said retracted position to said operating position.

6. The fixing unit according to claim 1, wherein said rotation-providing mechanism comprises a contact roller that contacts a surface of said press roller when said press roller is positioned at a retracted position.

7. The fixing unit according to claim 6, wherein said contact roller is rotated by said rotating mechanism.

8. The fixing unit according to claim 6, wherein said press roller is rotated by movement of said press roller with respect to said contact during movement of said press roller from a retracted position to said operating position.

9. The fixing unit according to claim 1, wherein said rotation-providing mechanism is a slide arm movable in a tangential direction of said press roller, said slide arm having a contact member contacting a surface of said press roller when said press roller is positioned at a retracted position.

10. The fixing unit according to claim 9, wherein said slide arm is linked with said moving mechanism to move an said press roller between said operating position and said retracted position.

11. The fixing unit according to claim 1, wherein said rotation-providing mechanism comprises a fan for supplying air to said press roller, and an impeller is provided on said press roller to receive said air supplied from said fan, thereby rotating said press roller.

12. The fixing unit according to claim 11, wherein said impeller is provided on at least one axial end of said press roller.

13. The fixing unit according to claim 1, wherein a rotational speed of said press roller at a moment immediately before said press roller and said heat roller sandwich said recording sheet is within a range of −50% to +50% of a rotational speed of said heat roller.

14. A fixing unit for fixing images on a recording sheet, comprising:

a heat roller accommodating a heater;

a press roller for pressing a recording sheet towards said heat roller; and a moving mechanism which opens and closes a gap between said press roller and said heat roller;

wherein axial end portions of at least one of said press roller and said heat roller have an outer diameter larger than an outer diameter of intermediate portion between said axial end portions, the axial end portions having cylindrical outer surfaces.

15. The fixing unit according to claim 14, wherein a distance between said axial end portions is larger than a width of said recording sheet.

16. The fixing unit according to claim 14, wherein a difference in radius between said axial end portions and said intermediate portion is larger than the thickness of said recording sheet.

17. The fixing unit according to claim 14, wherein a hollow space is formed in each axial end portion so that said axial end portion is easily deformed.

18. The fixing unit according to claim 14, wherein said moving mechanism moves said press roller between an operating position where said press roller and said heat roller sandwich said recording sheet and a retracted position where said press roller is retracted from said operating position.

19. The fixing unit according to claim 14, further comprising a rotating mechanism which rotates said heat roller.

* * * * *